US011232668B2

(12) United States Patent
Blake et al.

(10) Patent No.: US 11,232,668 B2
(45) Date of Patent: Jan. 25, 2022

(54) COIN PROCESSING DEVICES AND METHODS

(71) Applicant: Cummins-Allison Corp., Mount Prospect, IL (US)

(72) Inventors: John R. Blake, St. Charles, IL (US); Frank J. Janezic, Lake Barrington, IL (US); Douglas U. Mennie, Barrington, IL (US)

(73) Assignee: Cummins-Allison Corp., Mount Prospect, IL (US)

( * ) Notice: Subject to any disclaimer, the term of this patent is extended or adjusted under 35 U.S.C. 154(b) by 8 days.

(21) Appl. No.: 16/923,959

(22) Filed: Jul. 8, 2020

(65) Prior Publication Data

US 2021/0012604 A1 Jan. 14, 2021

Related U.S. Application Data

(60) Provisional application No. 62/871,418, filed on Jul. 8, 2019.

(51) Int. Cl.

| | |
|---|---|
| ***G07D 9/00*** | (2006.01) |
| ***G07D 1/00*** | (2006.01) |
| *G07D 3/00* | (2006.01) |
| *B65B 67/12* | (2006.01) |

(52) U.S. Cl.

CPC ..... *G07D 9/008* (2013.01); *G07D 1/00* (2013.01); *G07D 9/002* (2013.01); *B65B 67/1222* (2013.01); *G07D 3/00* (2013.01); *G07D 2201/00* (2013.01); *G07D 2205/00* (2013.01)

(58) Field of Classification Search

CPC ..... G07D 9/008; G07D 9/002; G07D 1/00; G07D 3/00; G07D 2205/00; G07D 2201/00; B65B 67/1222; B65B 67/00; B65B 1/18; B65B 39/08; B65B 39/00; B65B 67/12; B65B 67/1233; B65B 67/1238; B65D 33/007; B65D 33/02; B65D 33/30; B65F 1/0006; B65F 1/1415

See application file for complete search history.

(56) References Cited

U.S. PATENT DOCUMENTS

| | | | |
|---|---|---|---|
| 4,543,969 | A | 10/1985 | Rasmussen |
| 5,542,880 | A | 8/1996 | Geib et al. |
| 5,564,974 | A | 10/1996 | Mazur et al. |
| 5,630,494 | A | 5/1997 | Strauts |
| 5,743,373 | A | 4/1998 | Strauts |

(Continued)

*Primary Examiner* — Jeffrey A Shapiro

(57) ABSTRACT

A coin processing device, comprising a coin processing module including an inlet for receiving coins to be processed and at least one coin output location, including an elongated sleeve for receiving the coins from the at least one outlet, wherein the elongated sleeve is operable to receive, in a first mode of operation of the coin processing device, a first flexible walled coin receptacle about the elongated sleeve, and wherein, in the first mode of operation, the coins are delivered by the elongated sleeve into the first flexible walled coin receptacle, and receive, in a second mode of operation of the coin processing device, a second coin receptacle within the elongated sleeve, wherein the second coin receptacle is a generally rigid container, and wherein, in the second mode of operation, the coins are delivered from the at least one outlet into the second coin receptacle positioned within the elongated sleeve.

20 Claims, 27 Drawing Sheets

(56) References Cited

U.S. PATENT DOCUMENTS

| | | | | |
|---|---|---|---|---|
| 5,865,673 | A | 2/1999 | Geib et al. | |
| 5,905,810 | A | 5/1999 | Jones et al. | |
| 5,943,655 | A | 8/1999 | Jacobson | |
| 5,982,918 | A | 11/1999 | Mennie et al. | |
| 5,997,395 | A | 12/1999 | Geib et al. | |
| 6,021,883 | A | 2/2000 | Casanova et al. | |
| 6,039,645 | A | 3/2000 | Mazur | |
| 6,042,470 | A | 3/2000 | Geib et al. | |
| 6,068,194 | A | 5/2000 | Mazur | |
| 6,171,182 | B1 | 1/2001 | Geib et al. | |
| 6,318,537 | B1 | 11/2001 | Jones et al. | |
| 6,579,165 | B2 | 6/2003 | Kuhlin et al. | |
| 6,603,872 | B2 | 8/2003 | Jones et al. | |
| 6,609,604 | B1 | 8/2003 | Jones et al. | |
| 6,637,576 | B1 | 10/2003 | Jones et al. | |
| 6,678,401 | B2 | 1/2004 | Jones et al. | |
| 6,724,926 | B2 | 4/2004 | Jones et al. | |
| 6,731,786 | B2 | 5/2004 | Jones et al. | |
| 6,748,101 | B1 | 6/2004 | Jones et al. | |
| 6,755,730 | B2 | 6/2004 | Geib et al. | |
| 6,810,137 | B2 | 10/2004 | Jones et al. | |
| 6,892,871 | B2 | 5/2005 | Strauts et al. | |
| 6,896,118 | B2 | 5/2005 | Jones et al. | |
| 6,996,263 | B2 | 2/2006 | Jones et al. | |
| 7,188,720 | B2 | 3/2007 | Geib et al. | |
| 8,545,295 | B2 | 10/2013 | Blake et al. | |
| 2004/0256197 | A1* | 12/2004 | Blake | G07D 3/00 194/350 |
| 2012/0156976 | A1* | 6/2012 | Blake | G07D 13/00 453/4 |

* cited by examiner

TABLE 1

| | | STANDARD SIZE FEDERAL RESERVE BAG | | | | COIN TOTE CAPACITY | | | SLEEVE VERSION 1 | | | SLEEVE VERSION 2 | | |
|---|---|---|---|---|---|---|---|---|---|---|---|---|---|---|
| COIN DEMON. | WEIGHT (GRAMS) | $ | NO. OF COINS | WEIGHT (GRAMS) | WEIGHT (LBS) | NO. OF COINS | WEIGHT (GRAMS) | WEIGHT (LBS) | NO. OF COINS | WEIGHT (GRAMS) | WEIGHT (LBS) | NO. OF COINS | WEIGHT (GRAMS) | WEIGHT (LBS) |
| 1¢ | 2.500 | $50 | 5000 | 12500 | 27.56 | 2000 | 5000.0 | 11.02 | 2000 | 5000 | 11.02 | 1400 | 3500 | 7.72 |
| 5¢ | 5.000 | $200 | 4000 | 20000 | 44.09 | 1500 | 7500.0 | 16.53 | 1180 | 5900 | 13.01 | 900 | 4500 | 9.92 |
| 10¢ | 2.268 | $1,000 | 10000 | 22680 | 50.00 | 2500 | 5670.0 | 12.50 | 2500 | 5670 | 12.50 | 1800 | 4082.4 | 9.00 |
| 25¢ | 5.670 | $1,000 | 4000 | 22680 | 50.00 | 1200 | 6804.0 | 15.00 | 950 | 5386.5 | 11.88 | 700 | 3969 | 8.75 |

*Fig. 18*

COIN PROCESSING DEVICES AND METHODS

CROSS-REFERENCE TO RELATED APPLICATIONS

This application claims the benefit of and priority to U.S. Provisional Patent Application No. 62/871,418, filed Jul. 8, 2019, which is incorporated herein by reference in its entirety.

TECHNICAL FIELD

The present disclosure relates generally to coin processing devices and related methods. In particular, aspects of this disclosure relate to coin processing machines and systems that utilize removable coin receptacles.

BACKGROUND

Previous coin processing devices have various shortcomings.

Some businesses, particularly banks, are regularly faced with a large amount of coin currency which must be organized, counted, and recorded. To hand count and record large amounts of coins of mixed denominations requires diligent care and effort, and demands significant manpower and time that might otherwise be available for more profitable and less tedious activity. To make counting of coins less laborious, machines have been developed which automatically sort, by denomination, a mixed group of coins, and discharge the denominated coins into receptacles specific to the various denominations. For example, coin processing machines for processing large quantities of coins from either the public at large or private institutions, such as banks and casinos, have the ability to receive bulk coins from a user of the machine, count and sort the coins, and store the received coins in one or more coin receptacles, such as coin bins or coin bags.

A well-known device for processing coins is the disc-type coin sorter. In one exemplary configuration, the coin sorter, which is designed to process a batch of mixed coins by denomination, includes a rotatable disc that is driven by an electric motor. The lower surface of a stationary, annular sorting head is parallel to and spaced slightly from the upper surface of the rotatable disc. The mixed batch of coins is progressively deposited on the top surface of the rotatable disc. As the disc is rotated, the coins deposited on the top surface thereof tend to slide outwardly due to centrifugal force. As the coins move outwardly, those coins which are lying flat on the disc enter a gap between the disc and the sorting head or guide plate. The lower surface of the sorting head is formed with an array of exit channels which guide coins of different denominations to different exit locations around the periphery of the disc. The exiting coins, having been sorted by denomination for separate storage, are counted by sensors packed along the exit channels. A representative disc-type coin sorting mechanism is disclosed in U.S. Pat. No. 5,009,627, to James M. Rasmussen, which is incorporated herein by reference in its entirety.

U.S. Published Patent Application Serial No. US 2004/0256197, assigned to the assignee of the present disclosure, is incorporated herein by reference in its entirety. U.S. Pat. Nos. 7,188,720 B2, 6,996,263 B2, 6,896,118 B2, 6,892,871 B2, 6,810,137 B2, 6,755,730 B2, 6,748,101 B1, 6,731,786 B2, 6,724,926 B2, 6,678,401 B2, 6,637,576 B1, 6,609,604, 6,603,872 B2, 6,579,165 B2, 6,318,537 B1, 6,171,182 B1, 6,068,194, 6,042,470, 6,039,645, 6,021,883, 5,997,395, 5,982,918, 5,943,655, 5,905,810, 5,865,673, 5,743,373, 5,630,494, 5,564,974, 5,542,880, and 4,543,969, each of which is assigned to the assignee of the present disclosure, and also each of which is incorporated herein by reference in its respective entirety.

SUMMARY

A method of operating a coin processing device is provided according to some embodiments. According to some embodiments, the coin processing device comprises at least one coin outlet and a plurality of output locations. According to some embodiments, each output location has an elongated sleeve associated therewith for receiving coins from the at least one outlet, and each sleeve has a first end and a second end. According to some embodiments, each sleeve has a first opening positioned near the first end of the sleeve and each sleeve having a second opening positioned near the second end of the sleeve. According to some embodiments, a first flexible coin bag is associated with each of the sleeves associated with the plurality of the output locations. According to some embodiments, the method comprises positioning a coin receptacle within a first one of the sleeves associated with a first one of the output locations, receiving coins delivered from the at least one outlet to the first output location into the coin receptacle positioned within the first sleeve, removing the coin receptacle from the first sleeve, and thereafter receiving coins in the first sleeve whereby coins received into the first sleeve are delivered into the first coin bag.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, which are considered to be inventive singly or in any combination, will be readily apparent from the following detailed description of representative embodiments and modes for carrying out various embodiments of the present disclosure when taken in connection with the accompanying drawings and the appended claims.

BRIEF DESCRIPTION OF THE DRAWINGS

For a more complete understanding of this disclosure, reference is now made to the following description, taken in conjunction with the accompanying drawings, in which:

FIG. 18 illustrates a table providing various information about various coin containers in accordance with various embodiments of this disclosure;

Figure 1A:
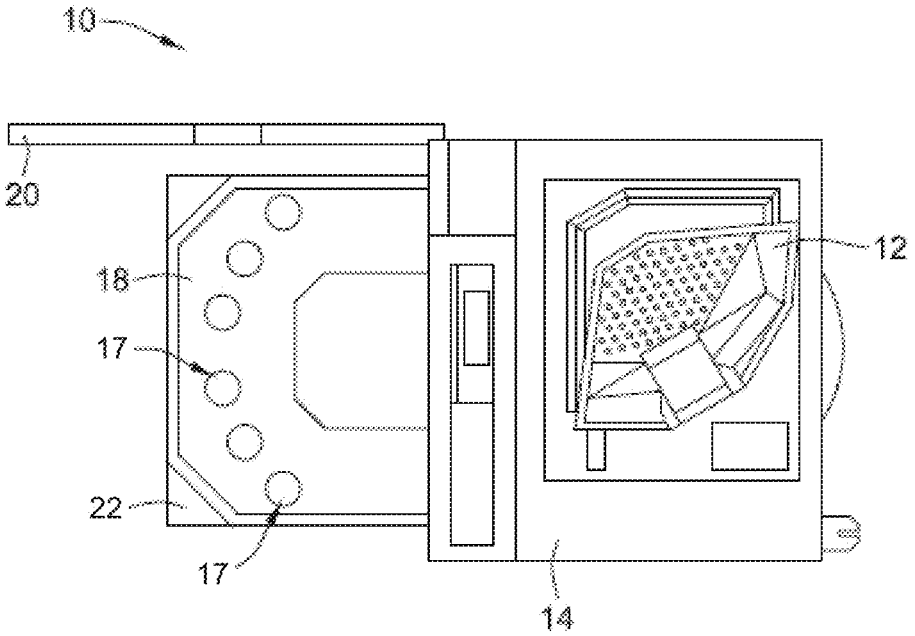
FIGS. 1A and 1B illustrate alternate views of a representative coin processing machine employing conventional coin bags in accordance with various embodiments of this disclosure.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, combinations, and alternatives falling within the spirit and scope of the inventions as defined by the appended claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

DETAILED DESCRIPTION

FIGS. 1A through 20, discussed below, and the various embodiments used to describe the principles of the present invention in this patent document are by way of illustration only and should not be construed in any way to limit the scope of the disclosure. Those skilled in the art will understand that the principles of this disclosure may be implemented in any suitably arranged device or system.

According to some embodiments, the operation of coin processing device 10 and its components are similar to those described in U.S. Pat. No. 8,545,295, incorporated herein by reference in its entirety.

Figure 1B:
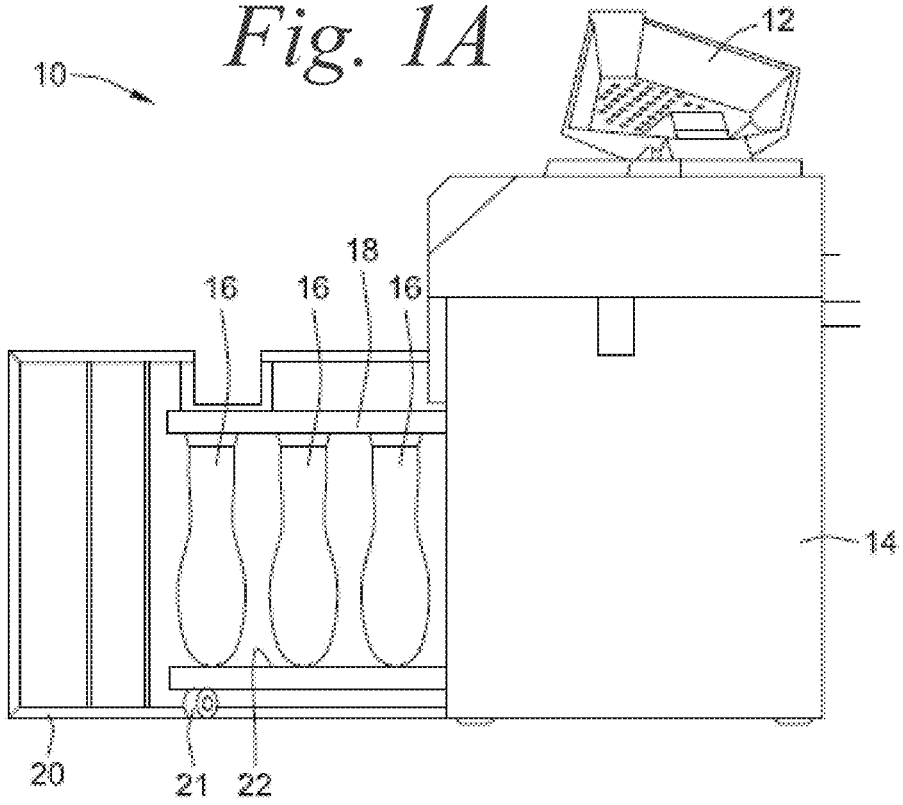

FIGS. 1A and 1B illustrate a coin processing device 10 having a pivoting coin input tray 12 configured to hold coins prior to inputting the coins into the coin processing device 10. The coin input tray 12 pivots upwardly to cause coins deposited therein to move, under the force of gravity through a hopper, funnel, or chute, into a sorting mechanism (not shown) disposed within a cabinet. The sorting mechanism discharges sorted coins through a plurality of holes 17, disposed through a moveable bag receptacle station 18, to a plurality of coin bags 16 (see FIG. 1B) suspended within a housing or cabinet 14. The bottoms of the bags may rest upon a platform 22, or may hang from bag holders attached to a support member of the moveable bag receptacle station 18, which can be configured (e.g., via casters 21, etc.) to travel into and out of the cabinet 14 to facilitate access to coin receptacle sleeves via door 20 by authorized personnel.

Figure 2:
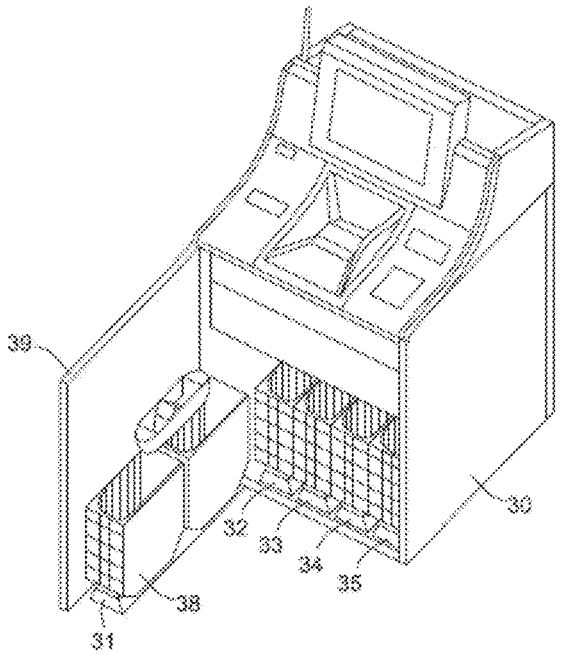
FIG. 2 illustrates a perspective-view of a representative coin processing machine unit employing moveable receptacles in accordance with various embodiments of this disclosure.

FIG. 2 illustrates an example wherein moveable receptacles 38 are disposed on glide units 31, 32, 33, 34, 35 that slide into and out of the of the housing 30 of the coin processing device when a door 39 is opened. The moveable receptacles 38 comprise coin bag partitions that prevent coin bags disposed in the moveable receptacles from interfering with adjacent coin bags as the coin bags become filled.

Figure 3:
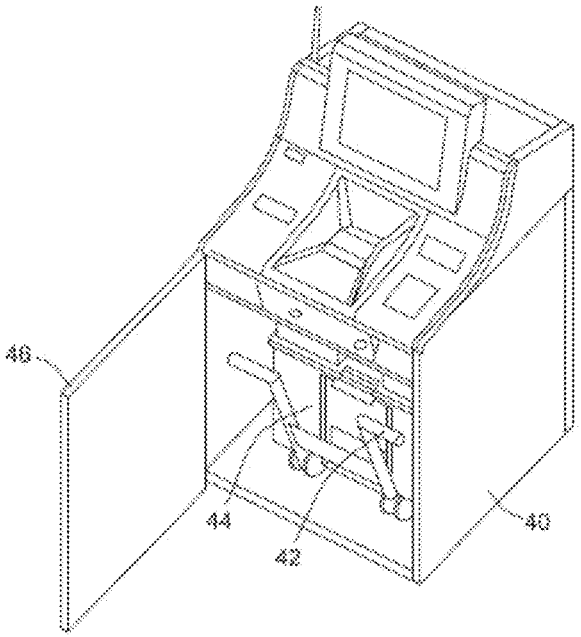
FIG. 3 illustrates a perspective-view of a representative coin processing machine unit employing a moveable coin bin in accordance with various embodiments of this disclosure.

FIG. 3 illustrates an example wherein a coin processing device includes a coin bin 44 disposed within the housing 40 and behind door 46, which is shown in an open position. In this configuration, all of the processed coins are commingled in the coin bin 44. The coin bin 44 is disposed on wheels and includes a handle 42 pivotally attached thereto for pulling the coin bin from within the housing.

FIGS. 4-9 illustrate various principles associated with coin receptacle sleeves as discussed in more detail in U.S. Pat. No. 8,545,295.

Figure 4:
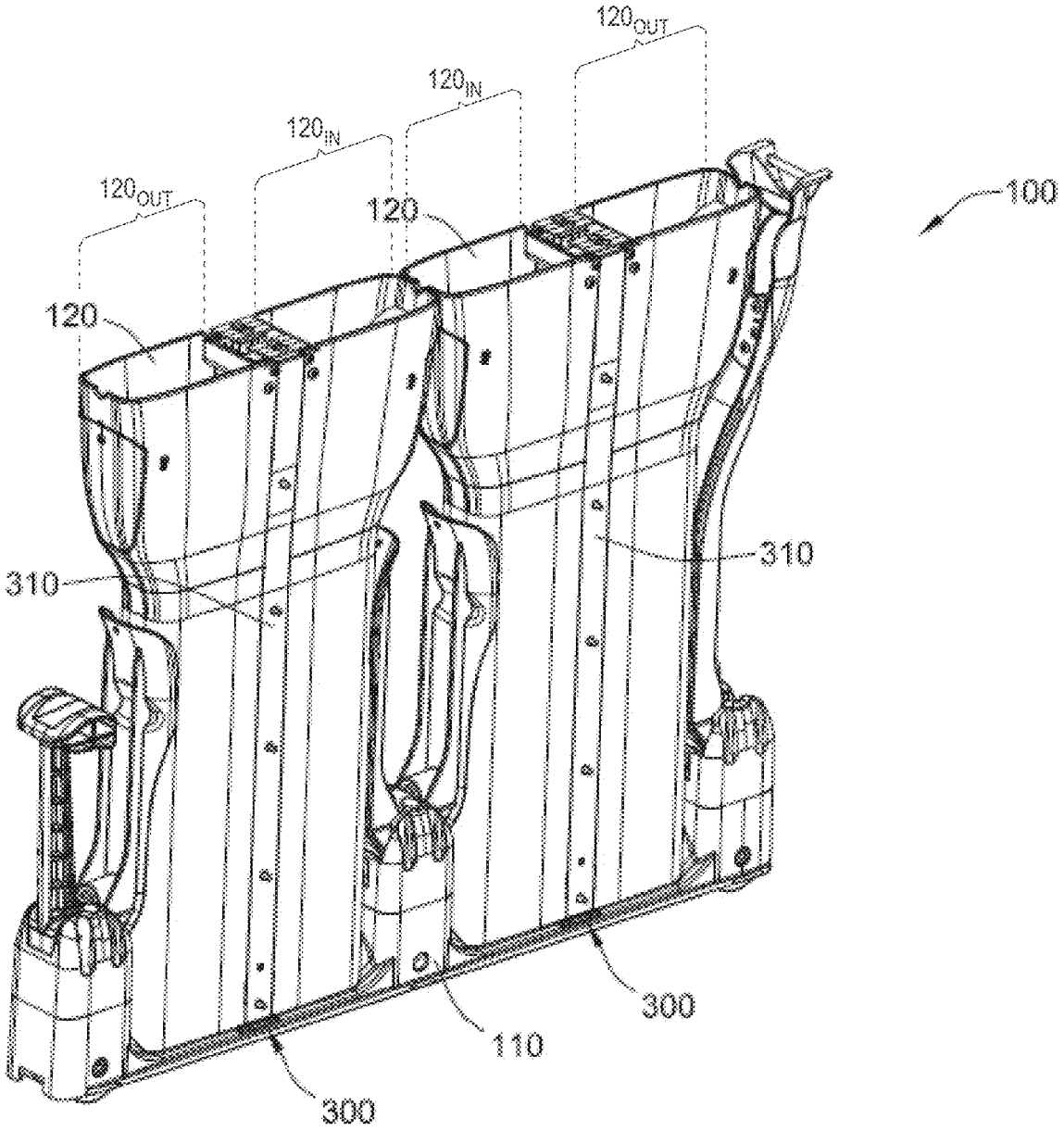
FIG. 4 illustrates a perspective-view of an example of a cable-free bag trolley bearing coin receptacle sleeves in accordance with various embodiments of this disclosure.

FIG. 4 illustrates a perspective-view of an example of a cable-free bag trolley 100 bearing coin receptacle sleeves 120 in accordance with various embodiments of this disclosure. According to some embodiments, for instance, the wheeled trolley 100 can include at least one, and in some embodiments a (first) plurality of electrical contacts, which may comprise, singly and in any combination, electrical contacts 300 (also referred to herein as "first electrical contact(s)") on the trolley base 110, and electrical contacts 310 (also referred to herein as "third electrical contact(s)") on the coin receptacle sleeves 120.

Figure 5:
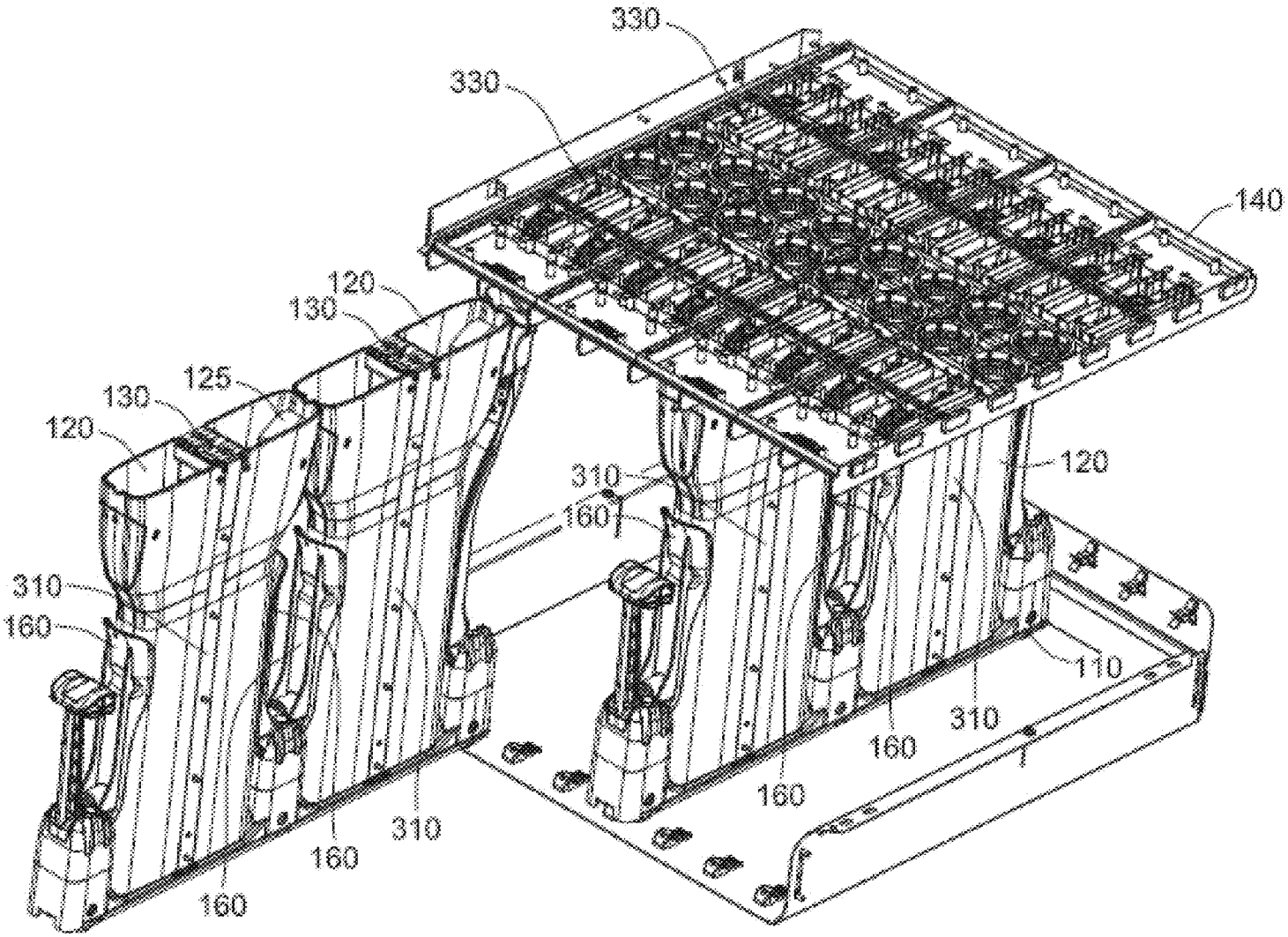
FIG. 5 illustrates a perspective-view of an example of a number of cable-free bag trolleys, in accordance with FIG. 4, and a coin receptacle sleeve bag logic system with manifold spring contacts functionally interacting with contacts on coin sleeves in accordance with various embodiments of this disclosure.

FIG. 5 illustrates a perspective-view of an example of a number of cable-free bag trolleys 100, in accordance with FIG. 4, and a coin receptacle sleeve bag logic system with manifold spring contacts functionally interacting with contacts on the receptacle sleeves 120 in accordance with various embodiments of this disclosure. According to some embodiments, the coin processing system can also include at least one, and in some embodiments a (second) plurality of electrical contacts, which may comprise manifold springs 330 (also referred to herein as "second electrical contact(s)") attached to a stationary manifold 140.

According to some embodiments and as described in more detail in U.S. Pat. No. 8,545,295, FIG. 5 illustrates aspects of a bag logic system configured to determine a state of the bag module, the combination of the coin receptacle sleeve 120 and coin bag (not shown) disposed thereover (see, e.g., FIG. 9), and annunciate the state of the bag module. The bag logic system may monitor correct coin receptacle sleeve 120 position, coin bag presence, coin presence within a coin receptacle sleeve 120, and impending coin overflow from a coin receptacle sleeve. According to some embodiments, in the bag logic system, electrical contacts 330, 320, 310, and 300 on the stationary manifold 140, coin receptacle sleeve handle 130, coin receptacle sleeve 120, and trolley base 110, respectively, provide three possible circuits for electric current. Depending on the states of the three circuits, the state of the bag module is known. Also shown in FIG. 5 are trolley cradle elements 160 and coin receptacle sleeve handles 130.

Figure 6:
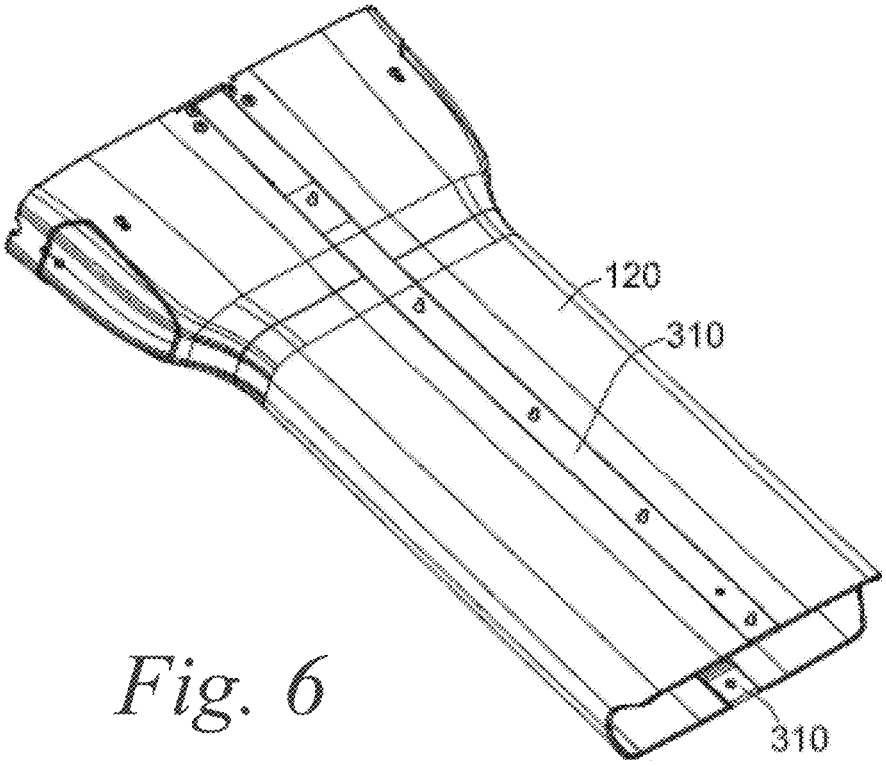
FIG. 6 illustrates a perspective-view of a representative coin processing device coin receptacle sleeve in accordance with aspects of the present concepts, showing conductive members extending along an outside surface of the coin receptacle sleeve from the top to the bottom of the coin receptacle sleeve, on both sides in accordance with various embodiments of this disclosure.

FIG. 6 illustrates a perspective-view of a representative coin processing device coin receptacle sleeve 120 in accordance with various embodiments of this disclosure. FIG. 6 shows conductive members 310 extending along an outside surface of the coin receptacle sleeve from the top to the bottom of the coin receptacle sleeve, on both sides.

Figure 7:
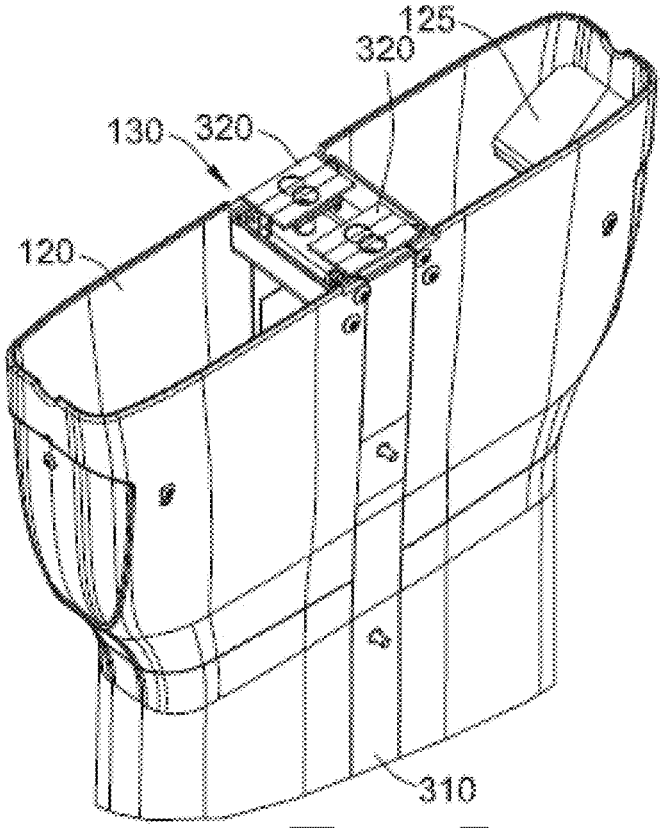
FIG. 7 illustrates an alternate perspective-view of the coin receptacle sleeve of FIG. 6, showing a top portion of the conductive members extending along the outside of the coin receptacle sleeve, and further showing an internal handle with manifold spring contacts in accordance with various embodiments of this disclosure.

FIG. 7 illustrates an alternate perspective-view of the coin receptacle sleeve of FIG. 6. FIG. 7 shows a top portion of the conductive members 310 extending along the outside of the coin receptacle sleeve. FIG. 7 also shows an internal handle 130 with manifold spring contacts 320 (also referred to herein as "fourth electrical contact(s)") on the coin receptacle sleeve handle 130.

Figure 8:
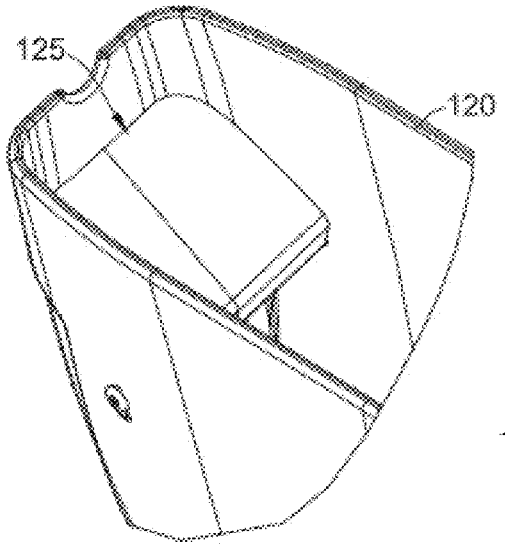
FIG. 8 illustrates an alternate perspective-view of a portion of the coin receptacle sleeve of FIG. 6, showing a deflector in accordance with various embodiments of this disclosure.

FIG. 8 illustrates an alternate perspective-view of a portion of the coin receptacle sleeve 120 of FIG. 6, showing a deflector 125 in accordance with various embodiments of this disclosure.

Figure 9:
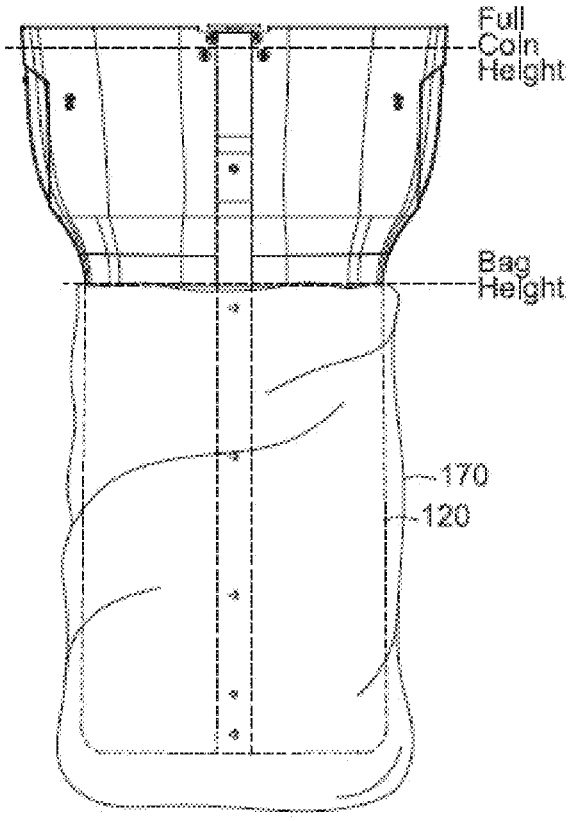
FIG. 9 illustrates a side-view of the coin receptacle sleeve of FIG. 6, showing a lower portion of the coin receptacle sleeve having a smaller cross-sectional area than an upper portion of the coin receptacle sleeve in accordance with various embodiments of this disclosure.

FIG. 9 illustrates a side-view of the coin receptacle sleeve of FIG. 6, showing a lower portion of the coin receptacle sleeve 120 having a smaller cross-sectional area than an upper portion of the coin receptacle sleeve 120 and illustrating a flexible coin bag 170 disposed about the bottom of the coin receptacle sleeve 120. FIG. 9 shows an example of a coin receptacle sleeve 120 body, illustrating a lower part (or "first portion") of the sleeve 120 having a smaller cross-sectional area than an upper part (or "second portion") of the sleeve 120 so that the sleeve 120 can fit inside of a standard coin bag 170. As indicated by the reference line labeled "Bag Height," according to some embodiments, some coin bags are designed so as not to extend to the top of the coin receptacle sleeve 120 and, instead, only rise to a level of the transition of the cross-sectional area of the receptacle sleeve from the smaller cross-sectional area to the larger cross-sectional area. Above the height of the coin bag 170, the cross-sectional area increases to advantageously give additional coin fill volume to the level indicated by the reference line for "Full Coin Height."

Figure 10A:
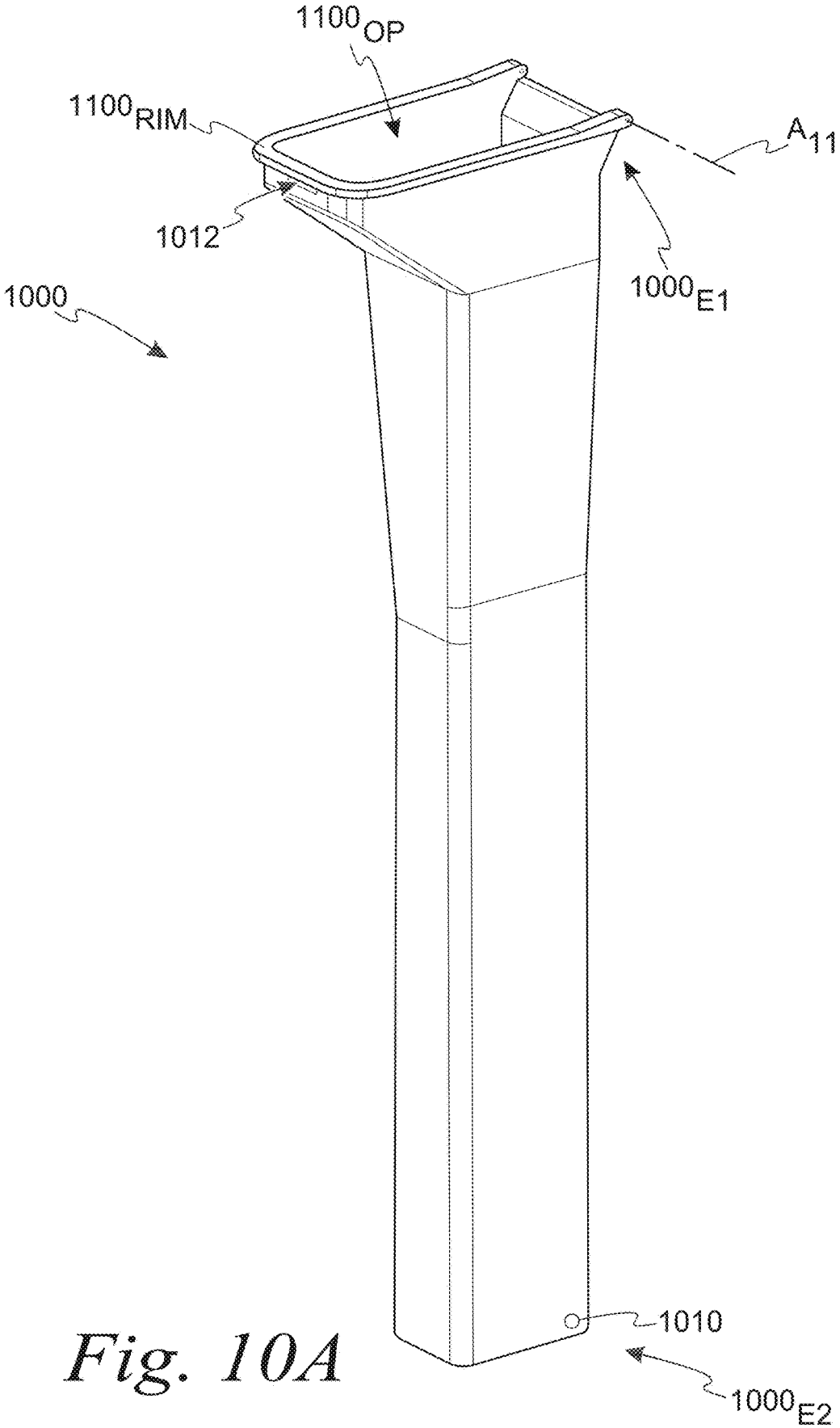
FIGS. 10A and 10B illustrate perspective views.
Figure 10B:
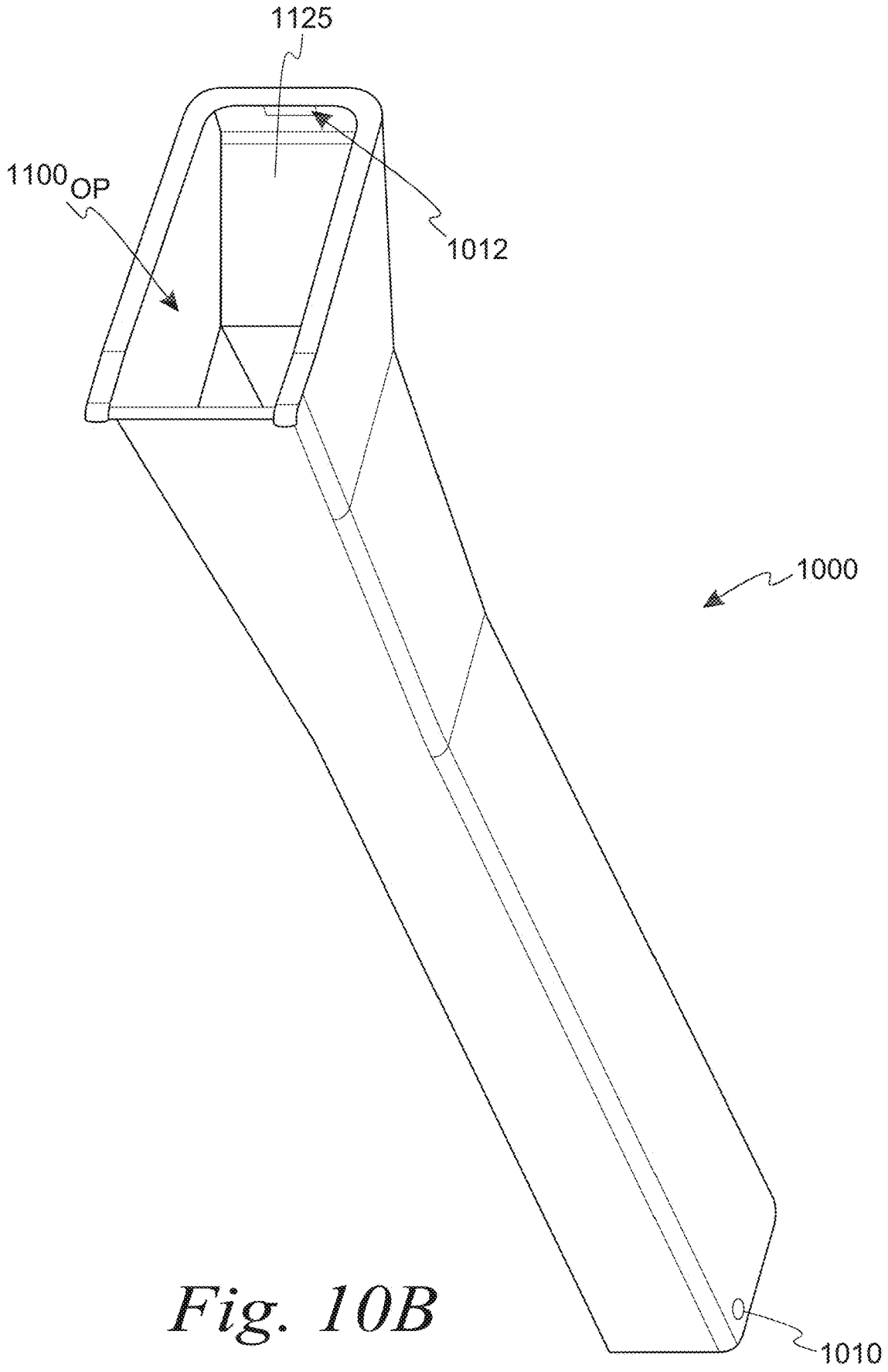
Figure 10C:
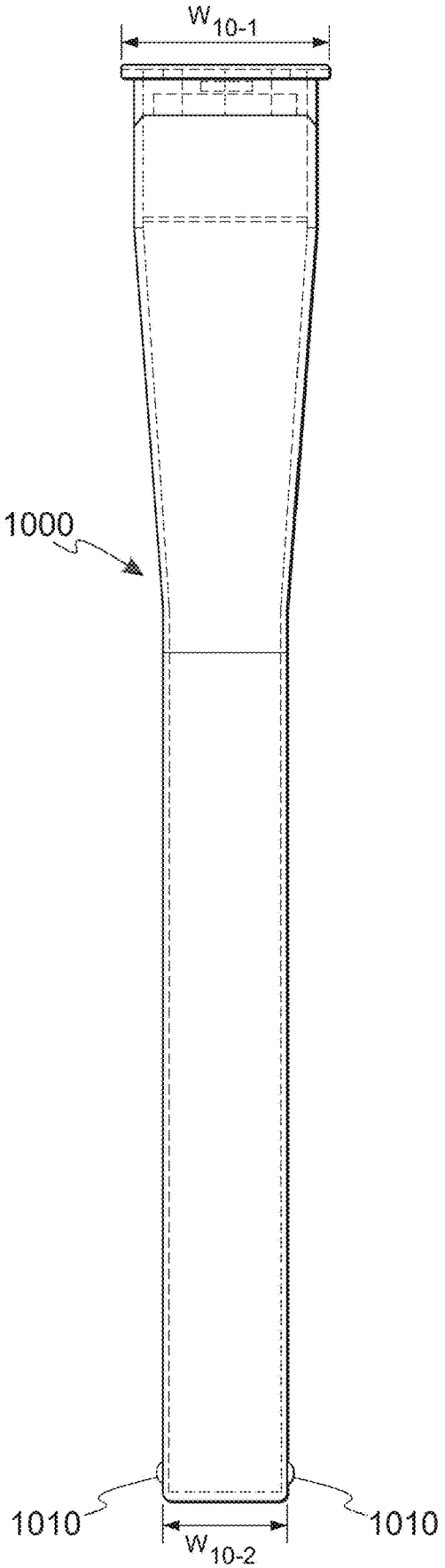
FIG. 10C illustrates an end view.
Figure 10D:
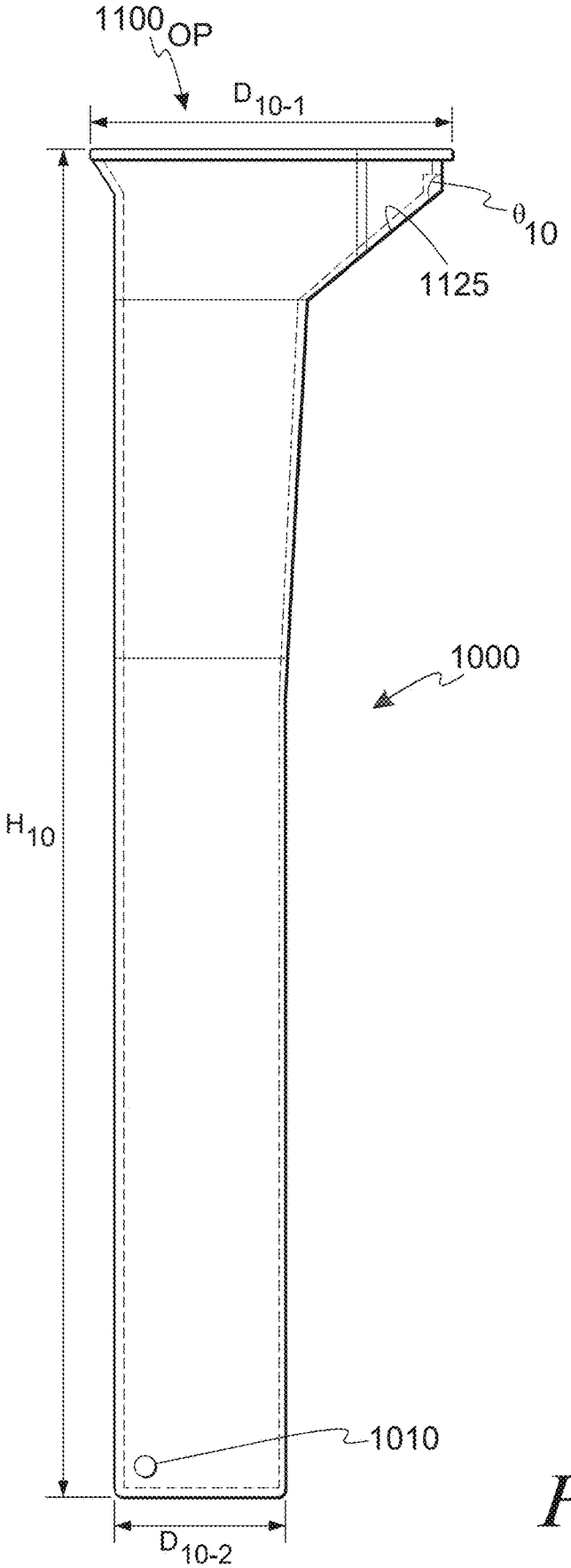
FIG. 10D illustrates a side view.
Figure 10E:
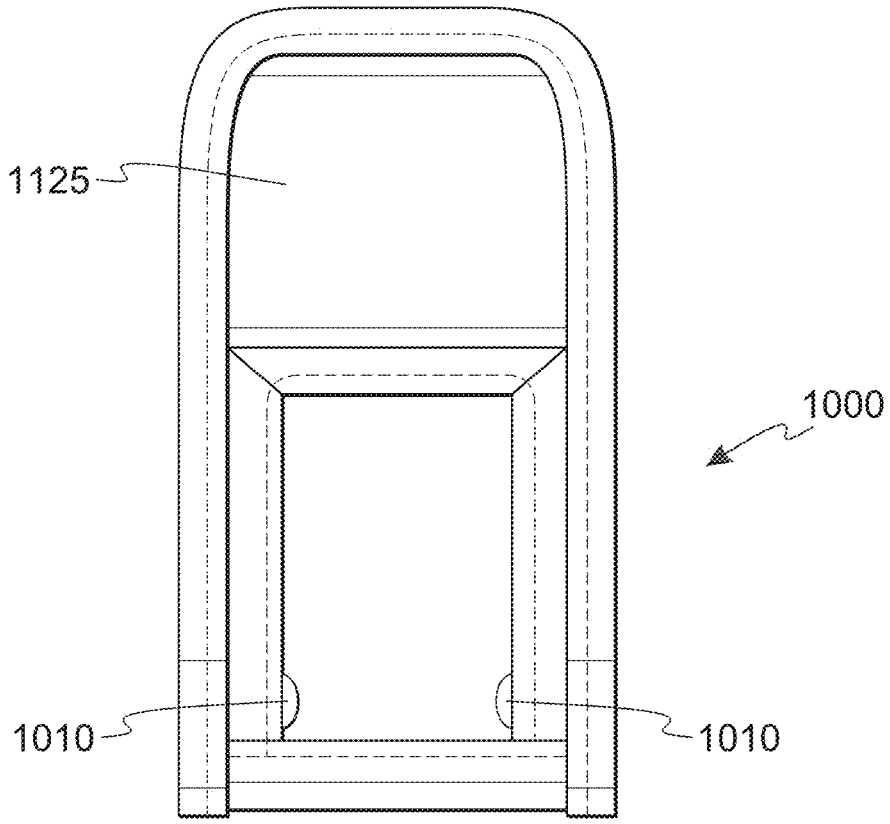
FIG. 10E illustrates a top view of a coin receptacle sleeve container in accordance with various embodiments of this disclosure.

FIGS. 10A and 10B illustrate perspective views, FIG. 10C illustrates an end view, FIG. 10D illustrates a side view, and FIG. 10E illustrates a top view of a coin receptacle sleeve container 1000 according to various embodiments of this disclosure. According to some embodiments, the coin receptacle sleeve container 1000 is made of a generally rigid material such as plastic or metal.

A generally rigid container 1000 has sides which do not collapse under their own weight and generally maintain or return to their original shape when a bending force is removed, e.g., while the container 1000 may bend slightly when a force is applied thereto, it returns to or close to its original shape when that force is removed. Likewise, the container 1000 having a first longitudinal end $\mathbf{1000}_{E1}$ and a second longitudinal end $\mathbf{1000}_{E2}$ (see FIG. 10A), generally maintains its shape even when held horizontally at one of its first or second longitudinal ends $\mathbf{1000}_{E1}$, $\mathbf{1000}_{E2}$. Conversely, a flexible coin bag 170 tends to collapse under its own weight (e.g, if the bottom of a coin bag 170 were held sideways, the sides of the coin bag 170 would tend to bend and fall below the bottom of the bag). Likewise, an empty flexible coin bag even if its bottom can be temporarily positioned on a flat surface so its walls sit upright, the walls of the coin bag do not return to such an upright position if a force is applied to cause the walls to bend over after such a force is removed (e.g., if a hand bends such a coin bag so as to be somewhat flat on the flat surface, the coin bag does not return to sitting upright when the hand is removed).

The coin receptacle sleeve container 1000 has an opening $\mathbf{1100}_{OP}$ located near a top of the coin receptacle sleeve container 1000 to permit coins to be deposited into or poured out of the coin receptacle sleeve container 1000. According to some embodiments, the coin receptacle sleeve container 1000 has a rim $\mathbf{1100}_{RIM}$ near the top of the coin receptacle sleeve container 1000.

According to some embodiments, the coin receptacle sleeve container 1000 has a shape and size designed to fit within a corresponding elongated sleeve or coin receptacle sleeve 120, 1220 (see FIGS. 12A-12E). According to some embodiments, the coin receptacle sleeve container 1000 has a shape and size corresponding to an interior shape and size of a corresponding coin receptacle sleeve 120, 1220 (see FIGS. 12A-12E) within which the container 1000 is designed to fit.

According to some embodiments, the coin receptacle sleeve container 1000 has a deflector 1125 designed to abut or be positioned adjacent to deflector 125, 1225 of a corresponding coin receptacle sleeve 120, 1220 (see FIGS. 12A-12E) when the container 1000 is positioned within the sleeve 120, 1220 in an operational position. According to some embodiments, the deflector 1125 is positioned at an angle $\Theta_{10}$ of about 135° from the vertical when the container 1000 is positioned within the sleeve 120, 1220 in an operational position.

According to some embodiments, the coin receptacle sleeve container 1000 has a height $H_{10}$ of between about 17 and 22 inches, of between about 18 and 21 inches, of between about 19 and 20 inches, of about 19.6 inches, of at least about 19 inches, and/or less than about 20 inches.

According to some embodiments, the coin receptacle sleeve container 1000 has an upper width $W_{10\text{-}1}$ of between about 2 and 3 inches, of between about 2½ and 3 inches, of between about 2.7 and 2.9 inches, of about 2.8 inches, of at least about 2.5 inches, and/or less than about 3 inches. According to some embodiments, the coin receptacle sleeve container 1000 has a lower width $W_{10\text{-}2}$ of between about 1 and 3 inches, of between about 1½ and 2 inches, of between about 1.6 and 1.8 inches, of about 1¾ inches, of at least about 1½ inches, and/or less than about 2 inches.

According to some embodiments, the coin receptacle sleeve container 1000 has an upper depth $D_{10\text{-}1}$ of between about 4 and 7 inches, of between about 5 and 6 inches, of between about 5.1 and 5.4 inches, of about 5.3 inches, of at least about 5 inches, and/or less than about 5.5 inches. According to some embodiments, the coin receptacle sleeve container 1000 has a lower depth $D_{10\text{-}2}$ of between about 1 and 3 inches, of between about 2 and 3 inches, of between about 2.4 and 2.6 inches, of about 2½ inches, of at least about 2.3 inches, and/or less than about 2.7 inches.

According to some embodiments, the coin receptacle sleeve container 1000 has a capacity of holding therein at least 2000 U.S. pennies, 1180 U.S. nickels, 2500 U.S. dimes, or 950 quarters as reflected in Sleeve Version 1 in Table 1 shown in FIG. 18. According to some embodiments, the coin receptacle sleeve container 1000 has a capacity of holding therein at least 1400 U.S. pennies, 900 U.S. nickels, 1800 U.S. dimes, or 700 quarters as reflected in Sleeve Version 2 in Table 1 shown in FIG. 18.

According to various embodiments, the sleeve container 1000 includes a plurality of electrical contacts 1010 such as pin and/or spring contacts that pass through the body of the sleeve container 1000 near a bottom portion of the sleeve container 1000. The position of the contacts 1010 on the sleeve container 1000 allows for the contacts 1010 to interact with other contacts on a coin receptacle sleeve, such as the coin receptacle sleeve 1220. For example, in some embodiments, the contacts 1010 of the sleeve container 1000 can contact a contact clip or edge stiffener 1240. The contact clip 1240 can be made of an electrically conductive material and can be in contact with contacts 1310 of the sleeve 1220, providing electrical conductivity between the contacts 1310 and the contacts 1010 via the contact clip 1240. Coins present within the sleeve container 1000 would touch or abut contacts 1010 on an opposite side of the contacts 1010 from where the contact 1010 encounter the contact clip 1240, allowing for detection of the coins in the sleeve container 1000.

As another example, the coin receptacle sleeve 1220 illustrated in FIGS. 12A-12E can include two lower sleeve electrical contacts 1360 coupled to lower portions inside the sleeve 1220, the two lower sleeve electrical contacts 1360 being electrically coupled to electrical contacts 1310 to detect the presence of coins in the sleeve 1220. When a sleeve container 1000 is inserted within the sleeve 1220, the lower sleeve electrical contacts 1360 come into contact with contacts 1010 of the sleeve container 1000 to detect the presence of coins within the sleeve container 1000. The contacts 1010 of the sleeve container 1000, when contacting the lower sleeve electrical contacts 1360, take advantage of the existing circuit or contact path that includes the lower sleeve electrical contacts 1360 to provide for the detection of coins within the sleeve container 1000. When a sleeve container 1000 is not used, the lower sleeve electrical contacts 1360 can provide for detection of coin presence for coins disposed within the sleeve 1220, such as when using a coin bag coupled to the sleeve 1220.

Figure 11A:
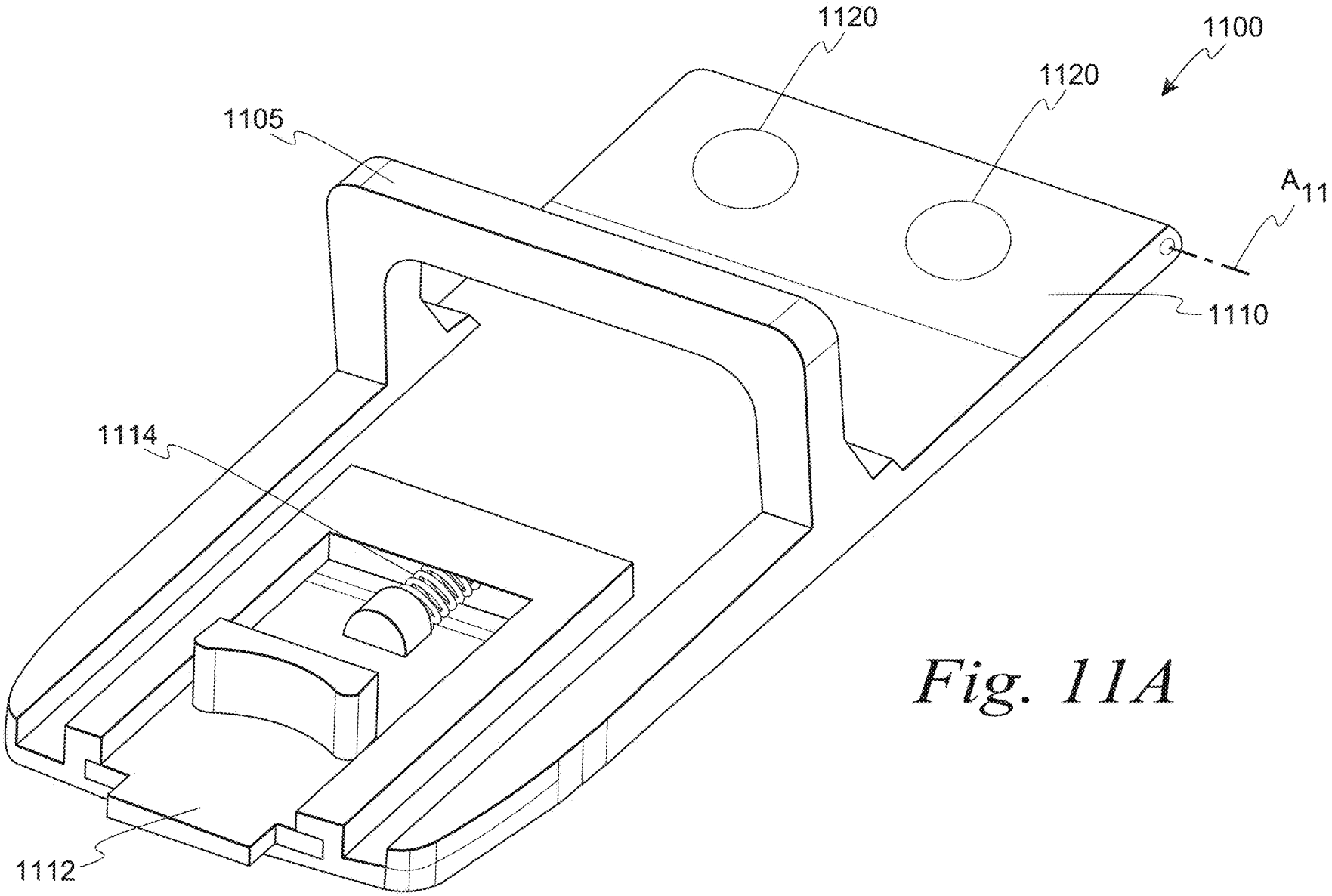
FIG. 11A illustrates a perspective view.
Figure 11B:
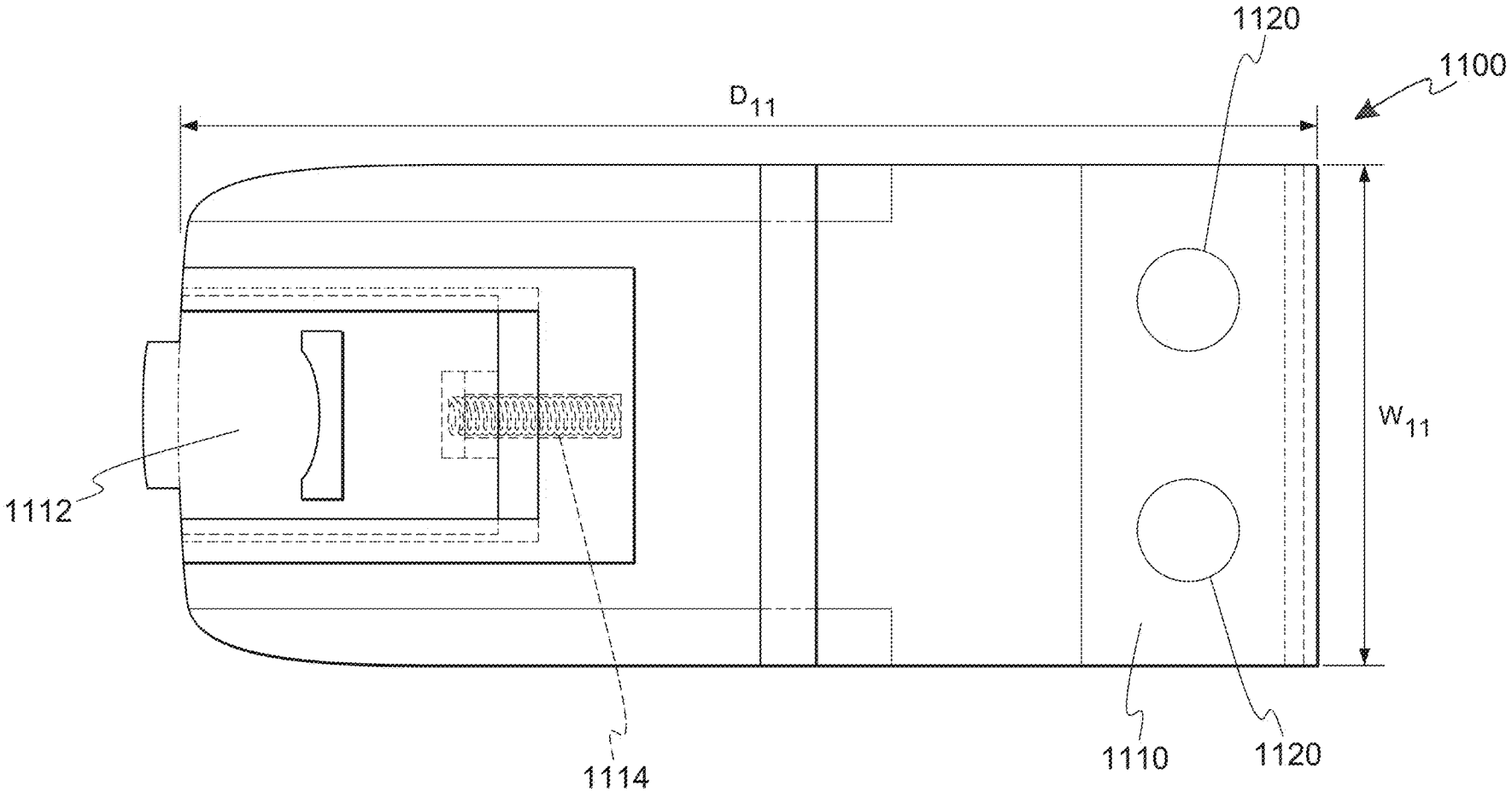
FIG. 11B illustrates a top view.
Figure 11C:
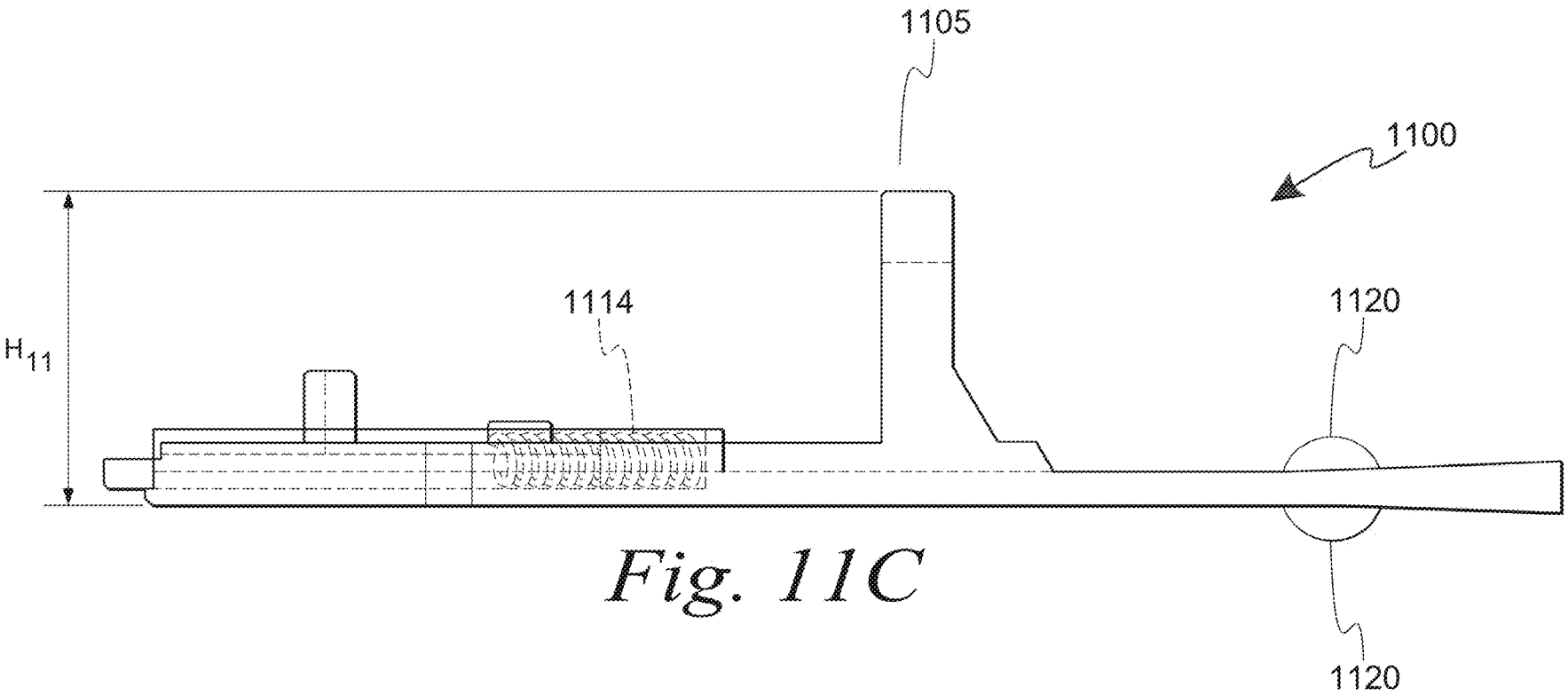
FIG. 11C illustrates a side view of a lid for a coin receptacle sleeve container in accordance with various embodiments of this disclosure.

FIG. 11A illustrates a perspective view, FIG. 11B illustrates a top view, and FIG. 11C illustrates a side view of a lid 1100 for a coin receptacle sleeve container 1000 according to various embodiments of this disclosure. According to some embodiments, the lid 1100 has a base 1110 and a latch 1112 moveably coupled to the base 1110. According to some embodiments, the latch 1112 is biased outward with respect to the base 1110 such as by a spring 1114.

The lid 1100 may also comprise a handle 1105 to aid in placing the coin receptacle sleeve container 1000 into and/or removing the coin receptacle sleeve container 1000 from a corresponding sleeve 120, 1220.

According to some embodiments, the lid 1100 is rotatably coupled to a corresponding coin receptacle sleeve container 1000 such that the lid 1100 may rotate relative to the container 1000 about axis Au positioned near one end of the lid 1100 and an upper end of the coin receptacle sleeve container 1000. According to some embodiments, the lid 1100 may rotate between a closed position wherein the opening $\mathbf{1100}_{OP}$ located near a top of the coin receptacle sleeve container 1000 is covered by the lid 1100 and an open position wherein the opening $\mathbf{1100}_{OP}$ located near a top of the coin receptacle sleeve container 1000 is not covered by the lid 1100. When the lid 1100 is in the closed position, coins may not be inserted into or removed from the coin receptacle sleeve container 1000. When the lid 1100 is in the open position, coins may be inserted into or removed from the coin receptacle sleeve container 1000.

According to some embodiments, when the lid 1100 is in the closed position, the latch 1112 is biased into an opening 1012 near the top of the coin receptacle sleeve container 1000 thereby maintaining the lid 1100 in the closed position even when the coin receptacle sleeve container 1000 is being held (such as by a person or operator) by the handle 1105 of the lid 1100. According to some embodiments, when the lid 1100 is in the closed position, the base 1110 of the lid 1100 is positioned adjacent the rim $\mathbf{1100}_{RIM}$ near the top of the coin receptacle sleeve container 1000. According to some embodiments, when the lid 1100 is in the closed position, a top of the base 1110 of the lid 1100 is positioned flush with a top of the rim $1100_{RIM}$ near the top of the coin receptacle sleeve container 1000 (see, e.g., FIG. 15).

According to some embodiments, the lid 1100 has a height $H_{11}$ of between about 0.8 and 1.3 inches, of between about 1 and 1.2 inches, of about 1.1 inches, of at least about 1 inches, and/or less than about 1.2 inches.

According to some embodiments, the lid 1100 has a width $W_{11}$ of between about 2 and 3 inches, of between about 2 and 2½ inches, of between about 2 and 2.2 inches, of about 2.2 inches, of at least about 2 inches, and/or less than about 2.2 inches.

According to some embodiments, the lid 1100 has a depth $D_{11}$ of between about 4 and 7 inches, of between about 5 and 6 inches, of between about 5 and 5.1 inches, of about 5 inches, of at least about 5 inches, and/or less than about 5.1 inches.

According to some embodiments, the container 1000 and/or lid 1100 comprise a lock to enable the container to be locked such as to aid in the secure storage and/or transportation of coins contained with the container 1000. Additionally or alternatively, according to some embodiments, the container 1000 and/or lid 1100 comprise openings to accommodate the insertion of a tamper evident tie (e.g., zip tie or cable tie) to enable the container to be maintained in a closed, secure manner such as to aid in the secure storage and/or transportation of coins contained with the container 1000.

In various embodiments of this disclosure, the lid 1100 also includes a plurality of lid contacts 1120. The lid contacts 1120 are disposed through the lid 1100 such that, when the lid 1100 is in the open position, the lid contacts 1120 touch or abut sleeve presence contacts of a coin receptacle sleeve, such as contacts 1320 of coin receptacle sleeve 1220 illustrated in FIGS. 12A-12E. The lid contacts 1120 allow for electrical current provided though the manifold contacts 330 of the manifold 140 to pass through the lid contacts 1120 to the contacts 1320 of the coin receptacle sleeve 1220. Current detected from the circuit comprising the contacts 1320 of the coin receptacle sleeve 1220, the manifold contacts 330, and, when the sleeve container 1000 is inserted into the coin receptacle sleeve 1220 and when the lid 1100 is in the open position, the lid contacts 1120 is used to determine the presence or absence of at least one of the coin receptacle sleeve 1220 and the sleeve container 1000. In some embodiments of this disclosure, the system, via the lid contacts 1120, can verify the sleeve container 1000 is in a correct orientation within the coin receptacle sleeve 1220, as further described herein with respect to FIG. 14B.

Figure 12A:
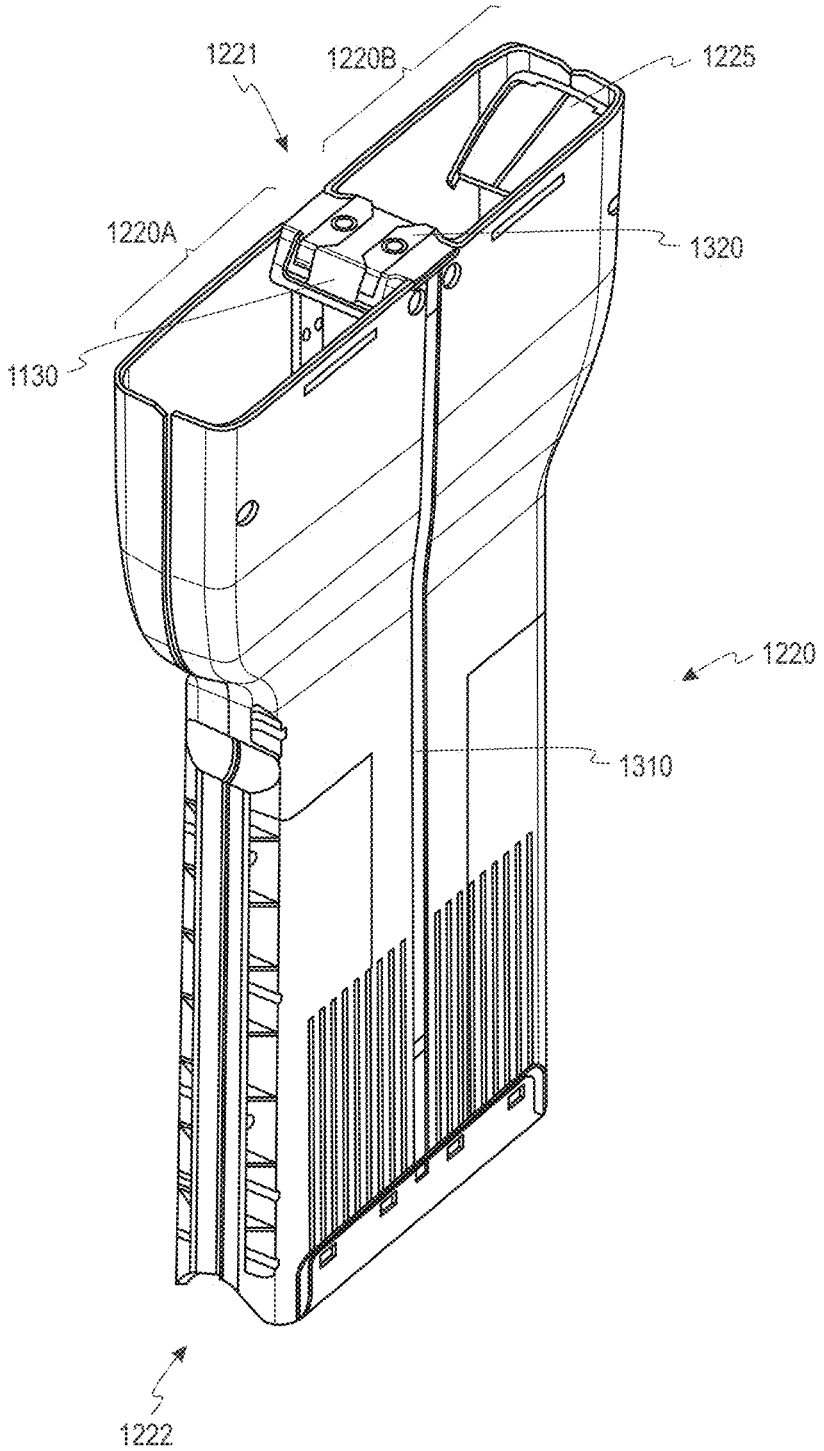
FIG. 12A illustrates a perspective view.
Figure 12B:
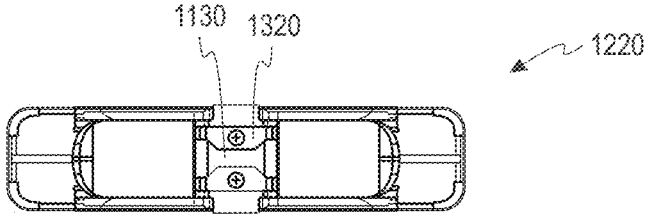
FIG. 12B illustrates a top view.
Figure 12C:
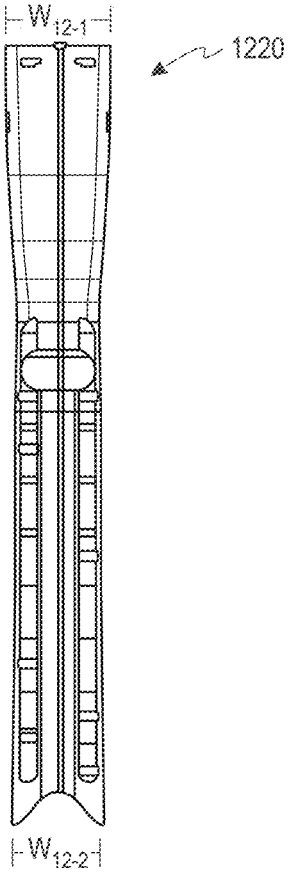
FIG. 12C illustrates an end view.
Figure 12D:
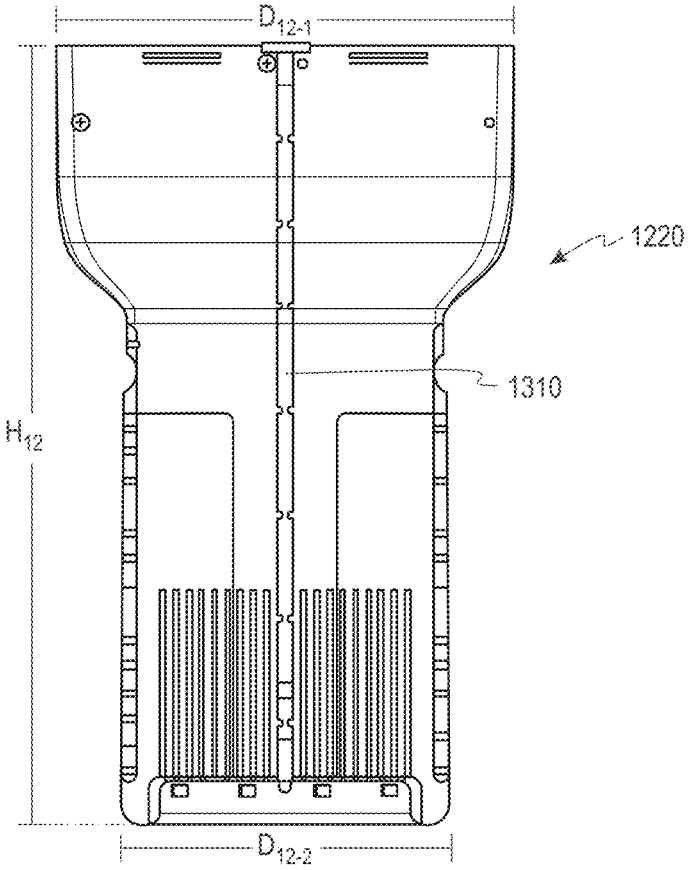
FIG. 12D illustrates a side view.
Figure 12E:
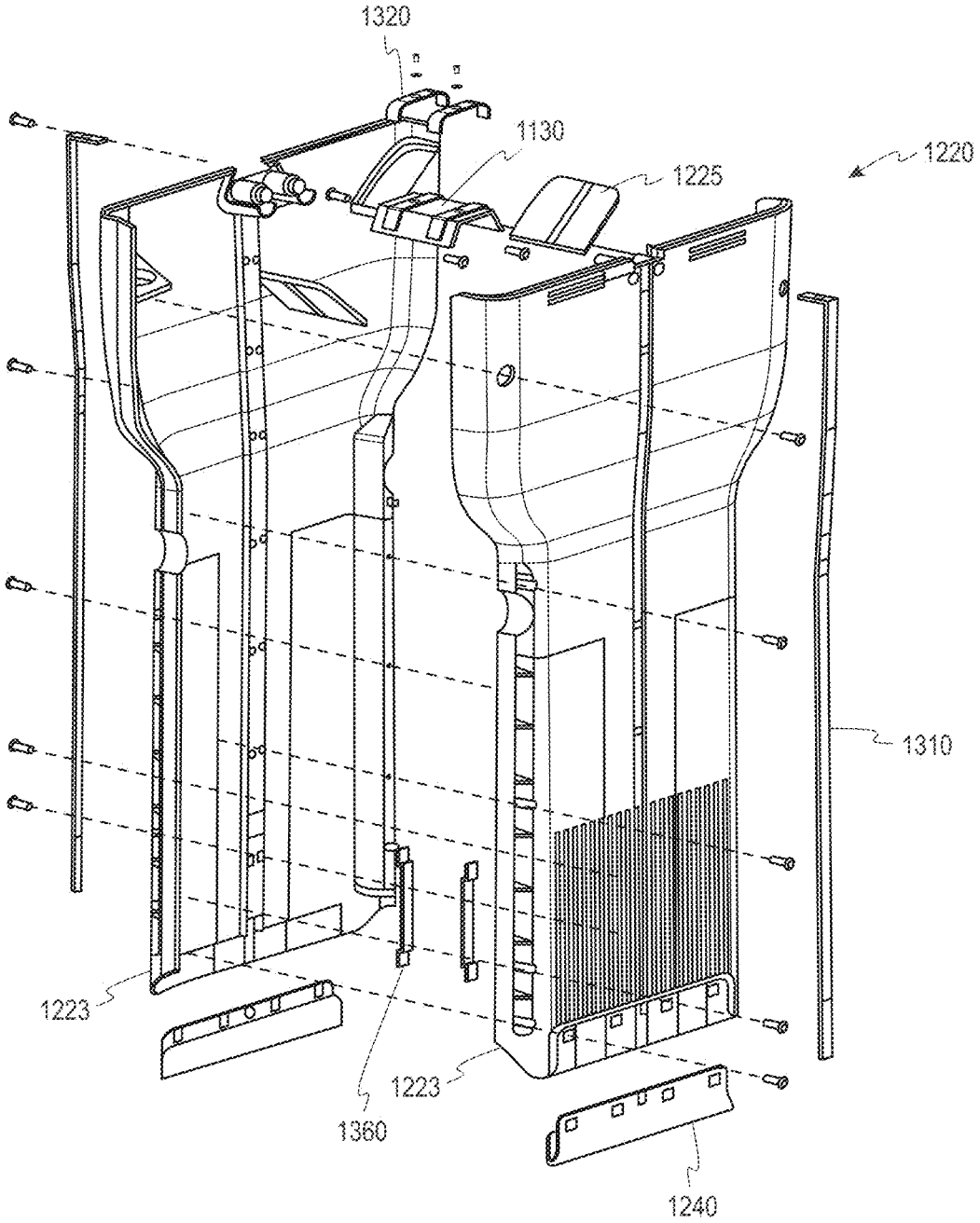
FIG. 12E illustrates an exploded perspective view of a coin receptacle sleeve in accordance with various embodiments of this disclosure.

FIG. 12A illustrates a perspective view, FIG. 12B illustrates a top view, FIG. 12C illustrates an end view, FIG. 12D illustrates a side view, and FIG. 12E illustrates an exploded perspective view of a coin receptacle sleeve 1220 according to various embodiments of this disclosure.

According to some embodiments, the coin receptacle sleeve 1220 comprises electrical contacts 1310 (corresponding to electrical contacts 310 above) which may extend generally vertically on the outsides of the sleeve 1220. According to some embodiments, the coin receptacle sleeve 1220 comprises an internal coin receptacle sleeve handle 1130 with manifold spring contacts 1320 (corresponding to coin receptacle sleeve handle 130 and manifold spring contacts 320, respectively, above). According to some embodiments, the coin receptacle sleeve 1220 comprises an edge stiffener 1240 which may be a generally rigid material such as an electrically conductive metal.

According to some embodiments, the coin receptacle sleeve 1220 may be made from two half sleeve pieces 1223. According to some embodiments, the half sleeve pieces are made from a generally rigid, non-conductive material such as plastic. As described with respect to FIGS. 10A-10E, according to various embodiments, the sleeve container 1000 includes a plurality of electrical contacts 1010 such as pin and/or spring contacts that pass through the body of the sleeve container 1000 near a bottom portion of the sleeve container 1000. The position of the contacts 1010 on the sleeve container 1000 allows for the contacts 1010 to interact with other contacts on the coin receptacle sleeve 1220. For example, in some embodiments, the contacts 1010 of the sleeve container 1000 can contact a contact clip or edge stiffener 1240. The contact clip 1240 can be made of an electrically conductive material and can be in contact with contacts 1310 of the sleeve 1220, providing electrical conductivity between the contacts 1310 and the contacts 1010 via the contact clip 1240. Coins present within the sleeve container 1000 would touch or abut contacts 1010 on an opposite side of the contacts 1010 from where the contact 1010 encounter the contact clip 1240, allowing for detection of the coins in the sleeve container 1000.

According to some embodiments, the coin receptacle sleeve 1220 comprises two lower sleeve electrical contacts 1360 coupled to lower portions inside the sleeve 1220. According to some embodiments, the lower sleeve electrical contacts 1360 are electrically coupled to electrical contacts 1310. According to some embodiments, the electrical contacts 1360 are used to detect the presence of coins in the sleeve 1220. In some embodiments, as also described with respect to FIGS. 10A-10E, when a sleeve container 1000 is inserted within the sleeve 1220, the lower sleeve electrical contacts 1360 come into contact with contacts 1010 of the sleeve container 1000 to detect the presence of coins within the sleeve container 1000. The contacts 1010 of the sleeve container 1000, when contacting the lower sleeve electrical contacts 1360, take advantage of the existing circuit or contact path that includes the lower sleeve electrical contacts 1360 to provide for the detection of coins within the sleeve container 1000. When a sleeve container 1000 is not used, the lower sleeve electrical contacts 1360 can provide for detection of coin presence for coins disposed within the sleeve 1220, such as when using a coin bag coupled to the sleeve 1220.

According to some embodiments, the coin receptacle sleeve 1220 has a height $H_{12}$ of between about 18 and 23 inches, of between about 19 and 22 inches, of between about 20 and 21 inches, of about 20.9 inches, of at least about 20 inches, and/or less than about 21 inches.

According to some embodiments, the coin receptacle sleeve 1220 has an upper width $W_{12-1}$ of between about 2 and 3 inches, of between about 2½ and 3 inches, of between about 2.7 and 2.9 inches, of about 2.8 inches, of at least about 2.5 inches, and/or less than about 3 inches. According to some embodiments, the coin receptacle sleeve 1220 has a lower width $W_{12-2}$ of between about 1 and 3 inches, of between about 2 and 3 inches, of between about 2.3 and 2.7 inches, of about 2.6 inches, of at least about 2½ inches, and/or less than about 3 inches.

According to some embodiments, the coin receptacle sleeve 1220 has an upper depth $D_{12-1}$ of between about 10 and 14 inches, of between about 11 and 13 inches, of between about 12 and 12½ inches, of about 12.2 inches, of at least about 12 inches, and/or less than about 13 inches. According to some embodiments, the coin receptacle sleeve container 1000 has a lower depth $D_{12-2}$ of between about 7 and 10 inches, of between about 8 and 9 inches, of between about 8.6 and 8.9 inches, of about 8.7 inches, of at least about 8½ inches, and/or less than about 9 inches.

The sleeve 1220 has a first opening 1221 through which coins may be received from the coin processing device 10 and a second opening 1222 through which coins may exit into a coin bag disposed about the sleeve 1220 such as when the sleeve 1220 is removed from the trolley 100. According to some embodiments, the sleeve has a somewhat funnel shape with a first end of the sleeve 1220 being larger than a second end, for example, according to some embodiments, first opening 1221 is larger than second opening 1222.

Figure 13A:
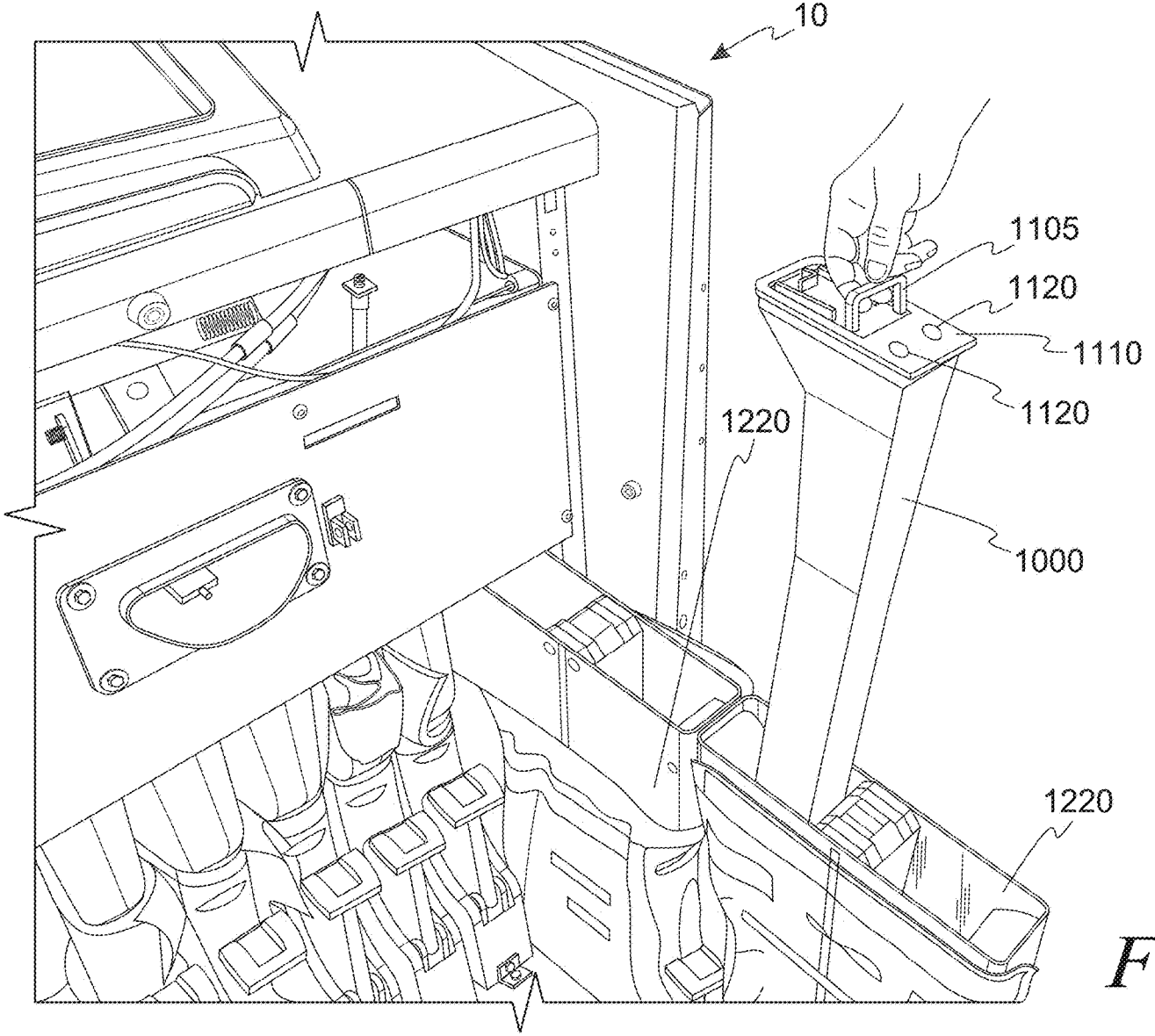
FIG. 13A illustrates a perspective view of a coin receptacle sleeve container positioned partially within a coin receptacle sleeve in accordance with various embodiments of this disclosure.
Figure 13B:
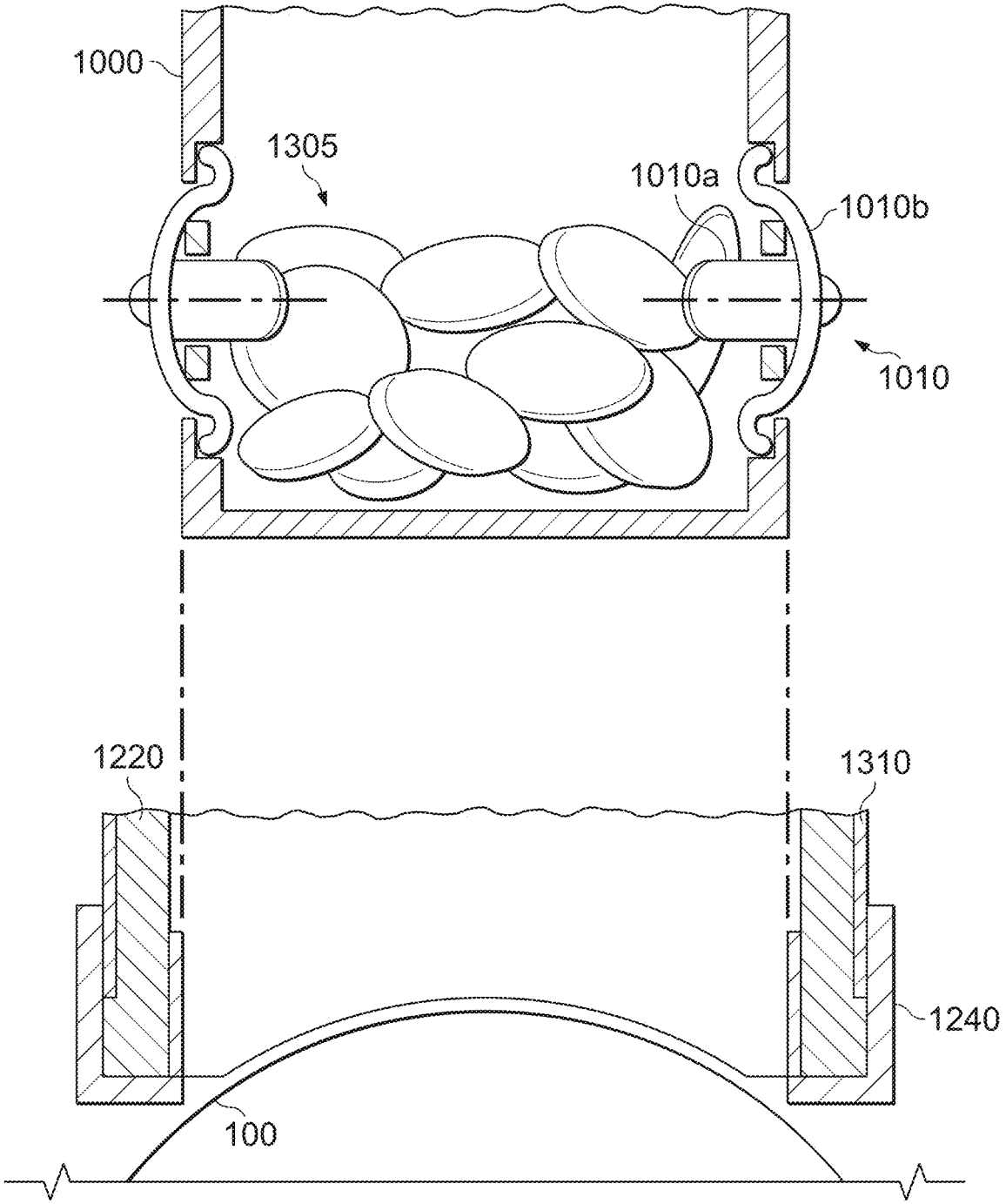
FIG. 13B illustrates a cross-sectional view of a coin receptacle sleeve container positioned within a coin receptacle sleeve.

FIGS. 13A and 13B illustrate views of a coin receptacle sleeve container 1000 being positioned within a coin receptacle sleeve 1220. FIG. 13A illustrates a perspective view of a coin receptacle sleeve container 1000 positioned partially within a coin receptacle sleeve 1220 in accordance with various embodiments of this disclosure. FIG. 13B illustrates a cross-sectional view of the coin receptacle sleeve container 1000 being positioned within the coin receptacle sleeve 1220.

As illustrated in FIG. 13A, the container 1000 is held by the handle 1105 of the lid 1100. An empty insertable container 1000 may be inserted into one side 1220A, 1220B (see FIG. 12A) of the sleeve 1220. With reference to FIG. 4, according to some embodiments, containers 1000 may be placed within one or more interior sides $\mathbf{120}_{IN}$ of sleeves 120 as according to some embodiments the coin processing device 10 delivers coins into the interior sides $\mathbf{120}_{IN}$ of each of the sleeves 120. Without a container 1000 being positioned within a given sleeve 120, 1220, coins deposited into the given sleeve 120, 1220 will be collected within a flexible coin bag positioned about the sleeve. However, if a container 1000 is positioned within a given sleeve 120, 1220, coins deposited into the given sleeve 120, 1220 will be collected within the container 1000 instead.

As illustrated in FIG. 13B, in some embodiments, each of the contacts 1010 of the sleeve container 1000 include a pin contact 1010*a* disposed through the body of the sleeve container 1000 and a spring contact 1010*b* coupled to the pin contact 1010*a*. The position of the contacts 1010 on the sleeve container 1000 allows for the contacts 1010 to interact with other contacts on the coin receptacle sleeve 1220. For example, as illustrated in FIG. 13B, the contacts 1010 of the sleeve container 1000 can contact the contact clip 1240. A lower portion of the sleeve container 1000 is positioned in an interior of the coin receptacle sleeve 1220 disposed on the trolley 100, such that the pin contacts 1010*a* rest against contact clip 1240. The contact clip 1240 can be made of an electrically conductive material and can be in contact with contacts 1310 of the sleeve 1220, providing electrical conductivity between the contacts 1310 and the contacts 1010 via the contact clip 1240. Coins 1305 present within the sleeve container 1000 would touch or abut the pin contacts 1010*a* on an opposite side of the pin contact 1010*a* from where the pin contact 1010*a* encounters the contact clip 1240, allowing for detection of the coins 1305 in the sleeve container 1000 via conductivity through the coins and between the contacts 1010, the contact clip 1240, the contact strip 1310, and the manifold contacts 330. As illustrated in FIG. 13B, the spring contacts 1010*b* are operable to elastically flex against pressure from the coins 1305 contacting the pin contacts 1010*a*, and against pressure from contact with the inside wall of the coin receptacle sleeve 1220, such that the contacts 1010 maintain contact with the coins 1305 and the contact clip 1240.

Figure 14A:
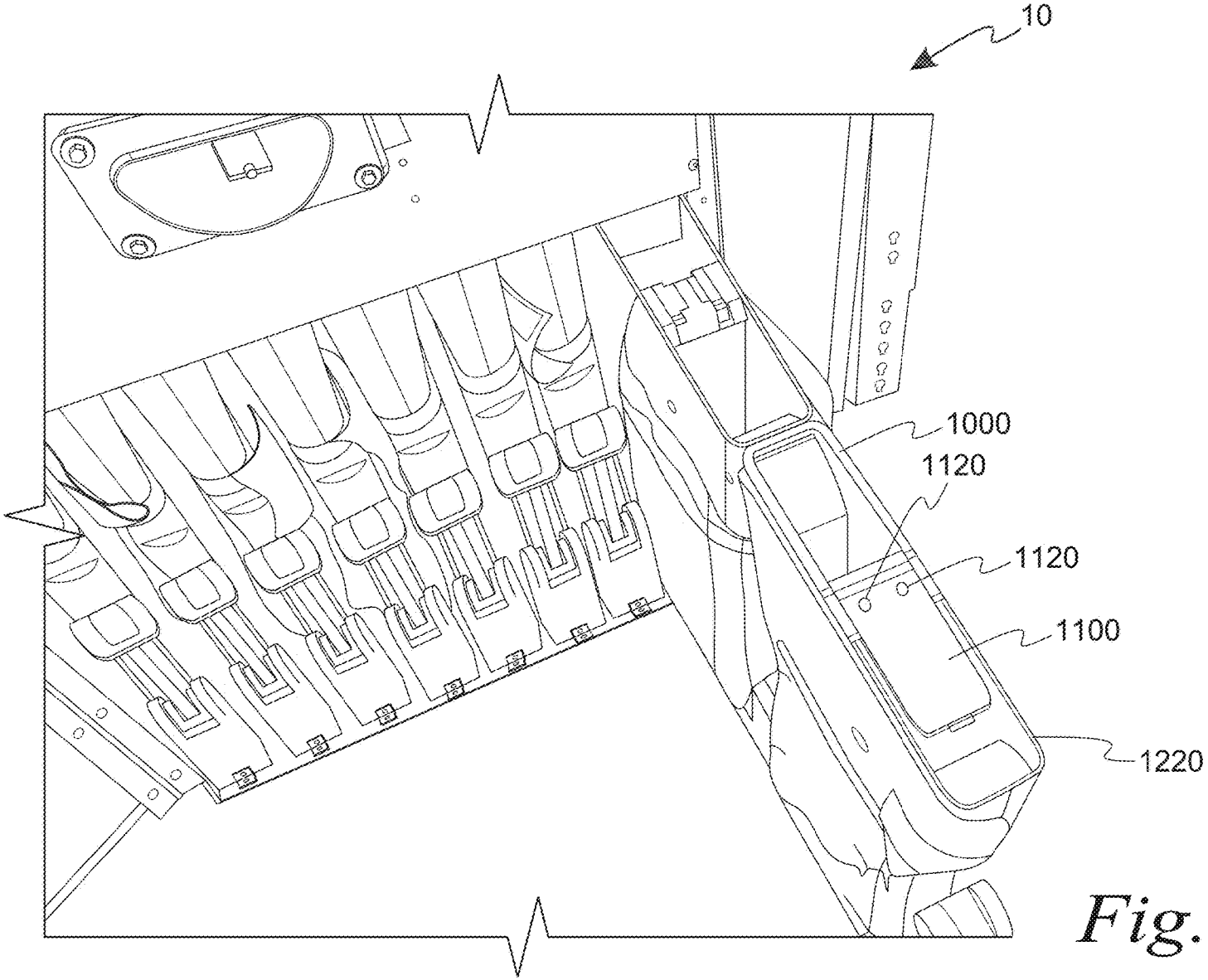
FIG. 14A illustrates a perspective view of a coin receptacle sleeve container positioned within a coin receptacle sleeve with a lid of the container in an open position in accordance with various embodiments of this disclosure.
Figure 14B:
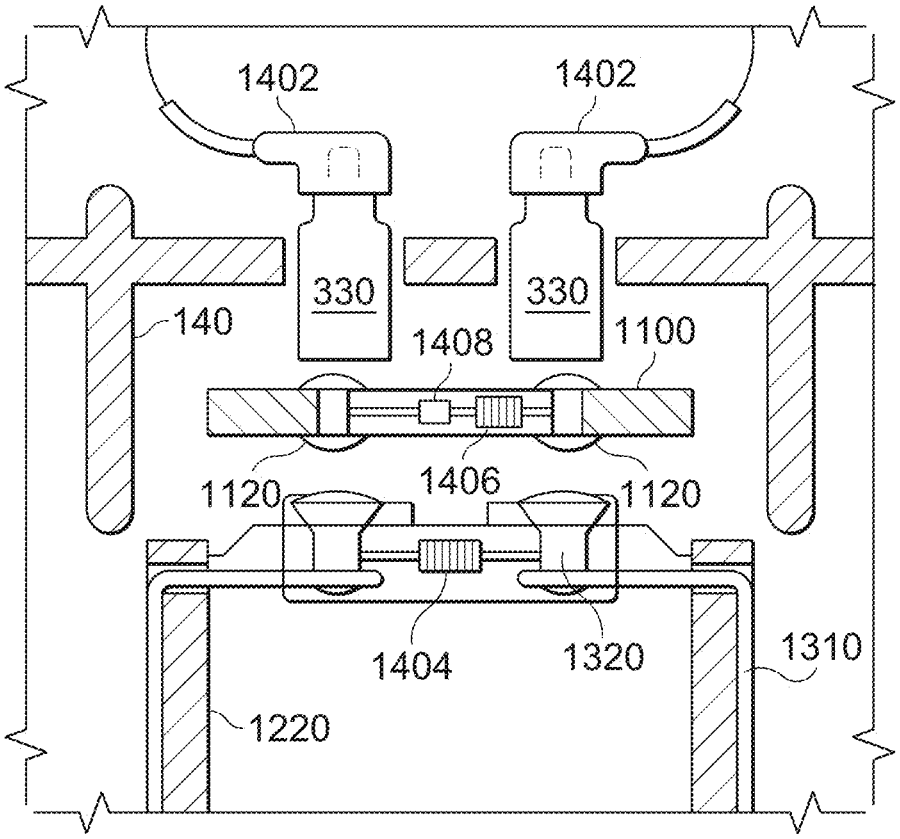
FIG. 14B illustrates a cross-sectional view of a lid of a container in an open position in relation to a coin receptacle sleeve.

FIGS. 14A and 14B illustrate view of a coin receptacle sleeve container 1000 positioned within a coin receptacle sleeve 1220 with a lid 1100 of the container 1000 in an open position according to various embodiments of this disclosure. FIG. 14A illustrates a perspective view of the coin receptacle sleeve container 1000 positioned within the coin receptacle sleeve 1220 with the lid 1100 of the container 1000 in the open position. FIG. 14B illustrates a cross-sectional view of the lid 1100 of the container 1000 in an open position in relation to the coin receptacle sleeve 1220.

As illustrated in FIG. 14A, after an empty container 1000 has been inserted into a sleeve 1220, the lid 1100 is moved to an open position so that coins directed to the sleeve may be collected within the container 1000. According to some embodiments, to open the lid 1100, the latch 1112 is slid out of the opening 1012 near the top of the coin receptacle sleeve container 1000 and the lid 1110 is rotated to an open position. Before operation of the coin processing device 10, the trolley 100 on which the sleeves 1220 are positioned is slid back into the cabinet of the coin processing device 10 and a cabinet door is closed.

In various embodiments of this disclosure, the lid 1100 also includes a plurality of lid contacts 1120. The lid contacts 1120 are disposed through the lid 1100 such that, when the lid 1100 is rotated into the open position as shown in FIG. 14A, the lid contacts 1120 touch or abut sleeve presence contacts of a coin receptacle sleeve, such as contacts 1320 of coin receptacle sleeve 1220. As illustrated in FIG. 14B, when the lid 1100 is in the open position, the lid contacts 1120 are positioned between the manifold contacts 330 of the manifold 140 and the contacts 1320 of the coin receptacle sleeve 1220. This allows for electrical current provided by an electrical connection 1402 coupled to the manifold contacts 330 of the manifold 140 to pass through the lid contacts 1120 to the contacts 1320 of the coin receptacle sleeve 1220. Current detected from the circuit comprising the contacts 1320 of the coin receptacle sleeve 1220, the manifold contacts 330, and, when the sleeve container 1000 is inserted into the coin receptacle sleeve 1220 and when the lid 1100 is in the open position, the lid contacts 1120 is used to determine the presence or absence of at least one of the coin receptacle sleeve 1220 and the sleeve container 1000.

As disclosed in the various embodiments herein, the system can determine the presence or absence of the coin receptacle sleeve 1220 based on circuit states detected through the manifold contacts 330. For example, when the circuit is open, this indicates that no coin receptacle sleeve 1220 is present. When the circuit is closed, this indicates the presence of the coin receptacle sleeve 1220. In some embodiments, a sleeve resistor 1404 can be connected between the contacts 1320 such that the presence of the coin receptacle sleeve 1220 can be further identified based on a known resistance. Similarly, to differentiate between when only the coin receptacle sleeve 1220 is installed and when both the coin receptacle sleeve 1220 and the sleeve container 1000 are installed, the lid 1100 of the sleeve container 1000 can also include a container lid resistor 1406 disposed between the lid contacts 1120, allowing for a second known resistance to indicate when the sleeve container 1000 is installed and the lid 1100 is in the open position. It will be understood that the resistances provided by the sleeve resistor 1404 and the container lid resistor 1406 can be configured as desired, such as using 1% resistors, so long as the resistances are differentiable.

In some embodiments of this disclosure, the system, via the lid contacts 1120, can verify the sleeve container 1000 is in a correct orientation within the coin receptacle sleeve 1220. In some embodiments, a container lid diode 1408 is included in the lid 1100 between the container lid resistor

1406 and one of the lid contacts 1120. For example, as illustrated in FIG. 14B, the container lid diode 1408 is disposed between the container lid resistor 1406 and, as oriented in FIG. 14B, the left lid contact 1120, such that current flows through the container lid resistor 1406 and then through container lid diode 1408. This causes different voltages to be detected at each of the lid contacts 1120. Therefore, the system can determine if the sleeve container 1000 is in the correct orientation within the coin receptacle sleeve 1220, as certain voltages are expected from each lid contact 1120 detected through each manifold contact 330. The various embodiments disclosed herein therefore allow for various states of the coin receptacle sleeve 1220 and the sleeve container 1000 to be detected. In various embodiments of this disclosure, such states can include a sleeve present state, a sleeve absent state, a bag installed state, a bag absent state, a coin present in bag state, a sleeve container present state, a sleeve container absent state, a coin present in sleeve container state, a sleeve container present and in correct orientation state, a sleeve container present and in incorrect orientation state, and coin overflow states. In some embodiments, operation of the system may be halted when a coin sleeve with a bag is not present, or a coin sleeve with a container is not present.

Figure 15:
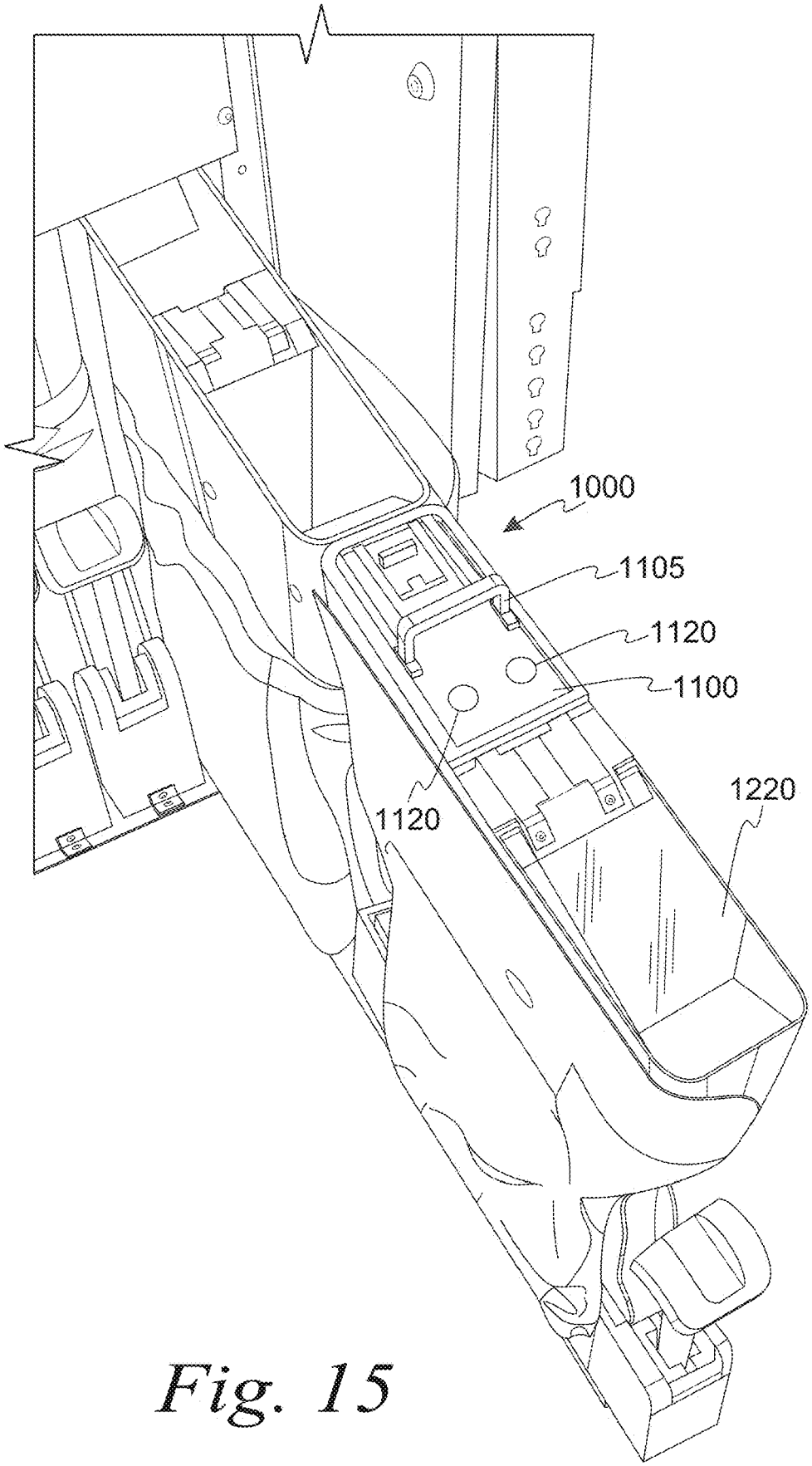
FIG. 15 illustrates a perspective view of a coin receptacle sleeve container positioned within a coin receptacle sleeve with a lid of the container in a closed position in accordance with various embodiments of this disclosure.

FIG. 15 illustrates a perspective view of a coin receptacle sleeve container 1000 positioned within a coin receptacle sleeve 1220 with a lid 1100 of the container 1000 in a closed position according to various embodiments of this disclosure. After a predetermined numbers of coins have been delivered into the container 1000, the coin processing device 10 may be programmed to stop delivering more coins into the container and a "coin full" condition may be set in a memory associated with the coin processing device 10 and/or an appropriate message or indication may be communicated to an operator of the coin processing device 10 such as via a user interface of the coin processing device 10.

When a container 1000 is to be removed from a sleeve 1220, the lid 1100 of the container 1000 may be rotated to a closed position and the latch 1112 of the lid 1100 may be slid into the opening 1012 near the top of the coin receptacle sleeve container 1000. Then, according to some embodiments, the container may be lifted out of the sleeve 1220 using the handle 1105 (see FIG. 13A).

According to some embodiments, a container 1000 containing coins which has been removed from the coin processing device 10 may be transported to another location, e.g., a back room and/or a safe, for storage and/or use such as to be used to fill a coin dispensing machine.

Figure 16:
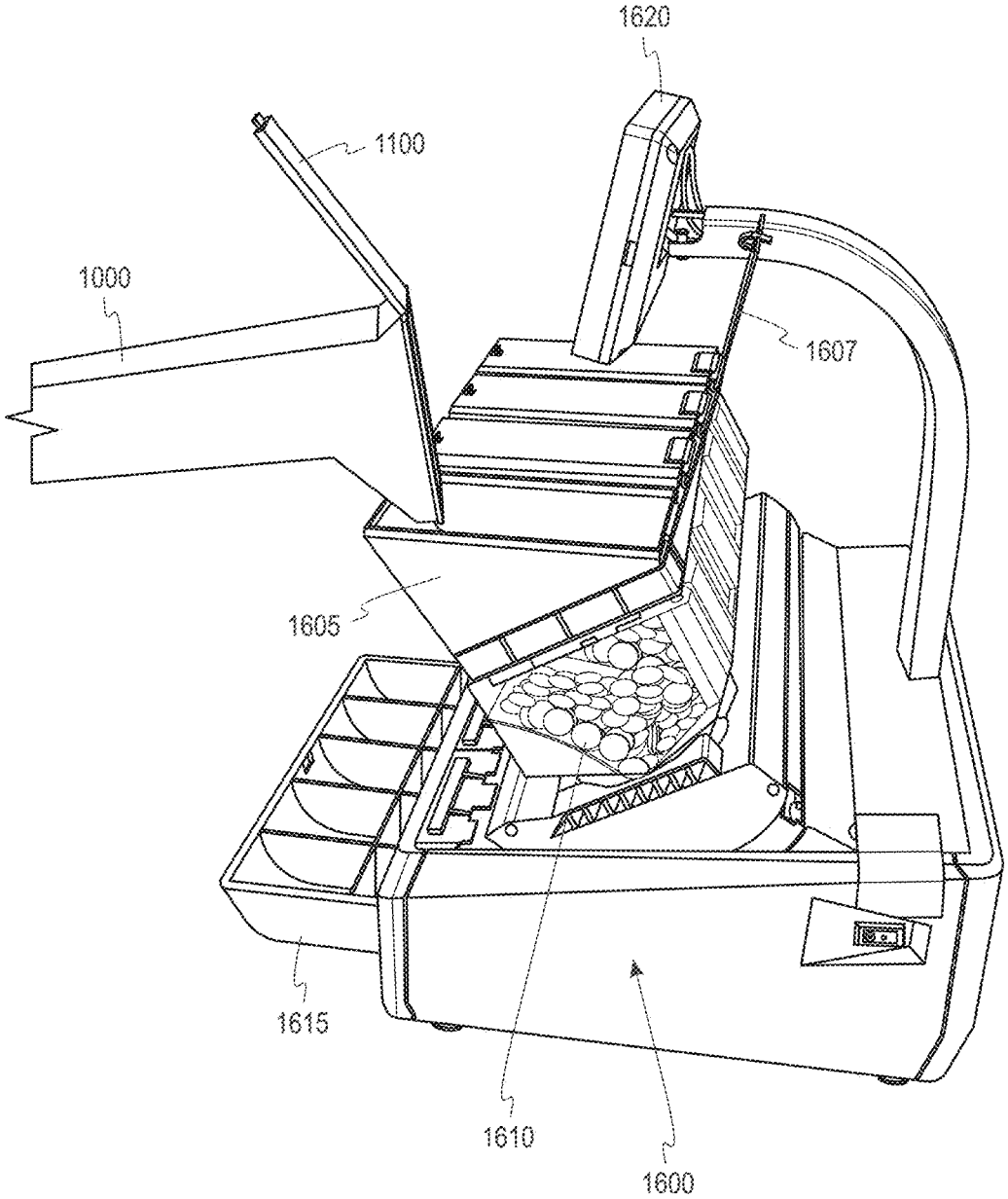
FIG. 16 illustrates a perspective view of a coin receptacle sleeve container positioned to permit coins therein to be poured into a coin receptacle of a coin dispensing machine in accordance with various embodiments of this disclosure.

FIG. 16 illustrates a perspective view of a coin receptacle sleeve container 1000 positioned to permit coins therein to be poured into a coin receptacle of a coin dispensing machine 1600 according to various embodiments of this disclosure. According to some embodiments, the coin dispensing machine 1600 comprises a plurality of hoppers 1610 which may have hopper extensions 1605 and lids 1607 associated therewith. According to some embodiments, each hopper 1610 is used to store a single denomination of coins, e.g., quarters, and the plurality of hoppers 1610 may be used to collectively store coins of a plurality of denominations of coins, e.g., pennies, nickels, dimes, quarters. The coin dispensing machine 1600 may then transfer select quantities of select denominations of coins to one or more other containers such as a cash till 1615, accutubes, coin rolls, etc.

According to some embodiments, a coin dispensing machine 1600 may comprise one or more container docks to permit one or more containers 1000 to be inserted into and/or coupled to a corresponding dock. According to some such embodiments, the docks may be configured to automatically open a container 1000 coupled thereto to allow coins to flow into a corresponding hopper 1610 of the coin dispensing machine 1600. The coin dispensing machine 1600 can also include one or more interface devices 1620, such as an operator interface comprising a touch screen configured to receive instructions from and/or display information to an operator of the coin dispensing machine 1600.

FIG. 18 illustrates a table providing various information about various coin containers according to various embodiments of this disclosure. As can be seen in Table 1 shown in FIG. 18, a standard Federal Reserve coin bag containing pennies contains 5000 pennies, while standard bags for nickels, dimes, and quarters contain 4000 coins, 10,000 coins, and 4000 coins, respectively. As can be seen in FIG. 18, the coins in a full a standard Federal Reserve coin bag weigh between about 27 and 50 pounds each. Lifting and working with full standard Federal Reserve coin bags can be difficult and/or impossible for some people and/or the flexible nature of the coin bags can make it difficult to manually pour the contents of a coin bag into another container such as a hopper of a coin dispensing machine.

As can be seen in FIG. 18, according to some embodiments, a container 1000 designed to fit within a coin sleeve 120, 1220 can be sized to accommodate and the coin processing device 10 can be programmed to deliver 2000 pennies, 1500 nickels, 2500 dimes, or 1200 quarters to a coin container 1000 wherein the coins in such containers weigh between about 11 and 17 pounds. Alternatively, according to some embodiments, a container 1000 designed to fit within a coin sleeve 120, 1220 can be sized to accommodate and the coin processing device 10 can be programmed to deliver 1400 pennies, 900 nickels, 1800 dimes, or 700 quarters wherein the coins in such containers weigh between about 8 and 10 pounds. The generally rigid nature of the containers 1000 can make it easier for a person to remove a full container 1000 from a coin processing device 10, carry the container, and/or pour coins out of the container into another container such as a hopper of a coin dispensing machine. Likewise, the lighter weight of a full container 1000 (relative to the weight of a full standard Federal Reserve coin bag) can make it easier for a person to remove a full container 1000 from a coin processing device 10, carry the container, and/or pour coins out of the container into another container such as a hopper of a coin dispensing machine.

Figure 19:
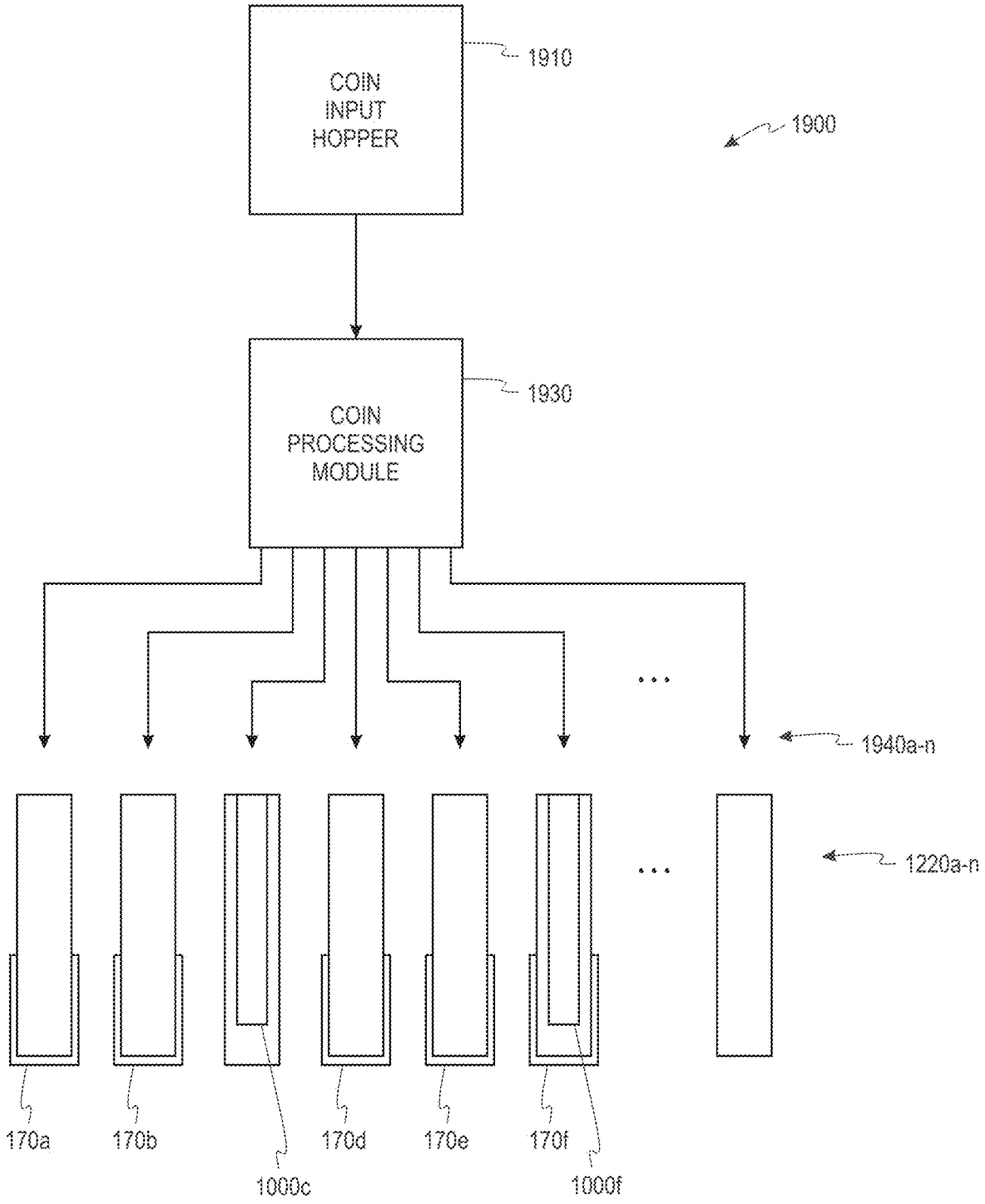
FIG. 19 illustrates a function block diagram of coin processing device in accordance with various embodiments of this disclosure.

FIG. 19 illustrates a function block diagram of coin processing device 1900 comprising a bulk coin input hopper 1910 and a coin processing module 1930 in accordance with various embodiments of this disclosure. According to some embodiments, the coin processing module 1930 sorts coins in a batch of coins received from the coin input hopper 1910 via a coin inlet by denomination and sends the sorted coins to one or more coin outlets to various output locations or positions 1940*a*-1940*n* with one or more of the output locations or positions 1940*a*-1940*n* each receiving coins of only a single denomination. According to some embodiments, one or more or all of the output locations 1940*a*-1940*n* have a coin sleeve 1220*a*-1220*n* associated therewith. According to some embodiments, one or more or all of the coin sleeves 1220*a*-1220*n* have a coin bag 170*a*-170*n* associated therewith and/or a coin container 1000 (e.g., 1000*c*, 1000*f*) associated therewith. Coins delivered by the coin processing module 1930 to the output locations 1940*a*-1940*n* may be directed into a coin sleeve 1220*a*-1220*n*. If a coin container (e.g., 1000*c*, 1000*f*) has been inserted in a particular coin sleeve (e.g., 1220*c*, 1220*f*), coins delivered to the corresponding output location (e.g., 1940*c*, 1940*f*) are collected in the corresponding container 1000. If a coin container (e.g., 1000*c*, 1000*f*) has not been inserted in a particular coin sleeve (e.g., 1220*a*, 1220*b*), coins delivered to the corresponding output location (e.g., 1940*a*, 1940*b*) are collected in the corresponding coin sleeve (e.g., 1220*a*, 1220*b*) and coin bag (e.g., 170*a*, 170*b*) disposed about the corresponding coin sleeve.

According to some embodiments, coins of a plurality of denominations may be sent to one or more mixed output locations 1940*a*-1940*n*, e.g., output location 1940*n* may receive both $1 and 50¢ coins. According to some embodiments, some coins may be sent to one or more reject output locations, e.g., output location 1940*n*−1 may receive coins that fail one or more authentication tests and/or coins that are determined to be from a currency system other than a type acceptable to a given coin processing device 10, e.g., a Canadian coin received in a coin processing device 10 set up to sort only U.S. coins.

Figure 17:
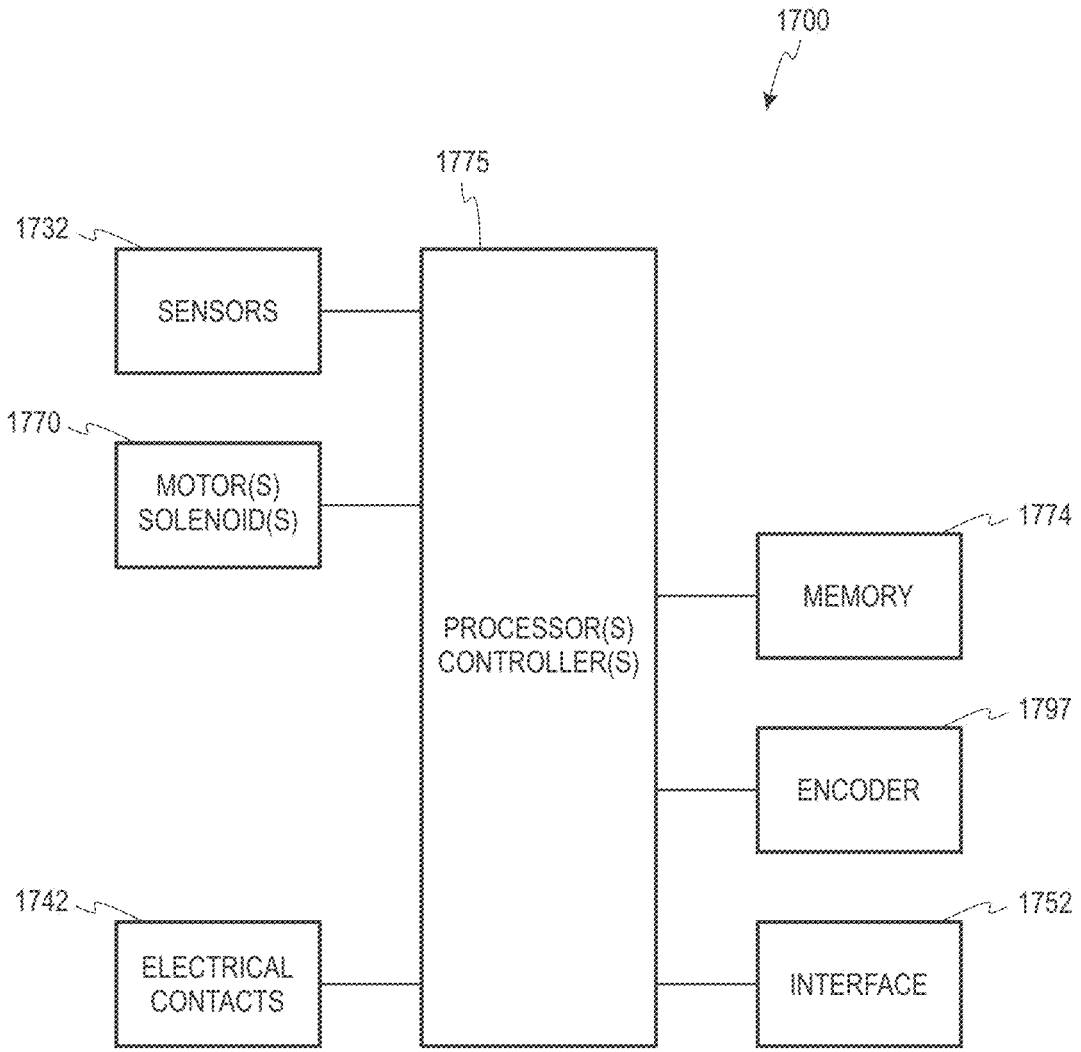
FIG. 17 illustrates a block diagram of some components of a coin processing machine in accordance with various embodiments of this disclosure.

FIG. 17 is a block diagram of some components of a coin processing machine 1700 according to some embodiments of the present disclosure. According to some embodiments, a coin processing machine 1700 such as, for example, coin processing device 10 described above, comprises one or more processors/controllers 1775 communicatively coupled to:

- one or more sensors 1732 (e.g., a sensor to detect coins placed into an input hopper of a coin processing device, one or more sensors to authenticate and/or denominate coins, one or more counting sensors to count coins of each of a plurality of denominations and/or to count how many coins have been delivered to each of a plurality of output locations such as coin receptacle sleeves 120, 1220 and/or containers 1000),
- one or more motors or solenoids 1770 (e.g., motors driving one or portions of a coin transport mechanism such as to rotate a disc used to sort coins and/or position various coin diverters or diverter tubes),
- one or more electrical contacts 1742 (e.g., electrical contacts 300, 310, 320, 330, 1010, 1120, 1310, 1320),
- one or more memories 1774 (e.g., a memory storing counts of the number of coins of each denomination processed in a batch of coins, the number of coins in each output coin receptacle (e.g., sleeve 120, 1200 or coin bag 170 and/or container 1000),
- one or more encoders 1797 (e.g., an encoder associated with a rotating disc used to sort coins), and/or
- one or more interfaces 1752 (e.g., an operator interface comprising a touch screen configured to receive instructions from and/or display information to an operator of the device 10, 1700).

According to some embodiments, the sleeves 120, 1220 and/or containers 1000 have one or more electrical contacts associated therewith that are communicatively coupled to the processor(s) 1775 which permit the processor(s) to detect when a sleeve 120, 1220 is properly installed in a given output position of the coin processing device 10, when a coin bag is properly installed about a sleeve 120, 1220 properly installed in a given output position, when a sleeve 120, 1220 is full, when a container 1000 is properly installed in a given sleeve 120, 1220 (e.g., in position $\mathbf{120}_{IN}$ shown in FIG. 4 according to some embodiments) and/or whether a container 1000 has a lid is an open or closed position, and/or when a container 1000 has been installed in an incorrect position within a sleeve (e.g., in position $\mathbf{120}_{OUT}$ shown in FIG. 4 according to some embodiments).

According to some embodiments, when the processor 1775 detects that a container 1000 has been properly inserted in a given sleeve 120, 1220 and that the container 1000 has its lid in an open position, the processors automatically adjusts to a coin limit associated with the corresponding output location. For example, when a coin processing device 10 is configured to send dimes to a first output position and the processor 1775 detects that coins sent to the first output position are to be collected in a coin bag positioned about a sleeve 120, 1220 located at that first output position, the processor sets the coin limit for the first output position to 10,000 coins. However, if the processor detects that a container 1000 has been properly inserted into the sleeve 120, 1220 located at that first output position, the processor sets the coin limit for the first output position to 2500 coins according to some embodiments or 1800 coins according to some alternate embodiments. When the coin limit is reached for the first output position, the processor 1775 may cause the coin processing device 10 to stop delivering coins to the first output position and set a flag that the first output position has reached its coin limit and/or alert an operator such as via the user interface 1752 that the coin bag 170 or container 1000 at the first output location is full and needs to be replaced with an empty coin bag 170 and/or container 1000. According to some embodiments, the coin processing device 10 has a plurality of output locations or positions (e.g., 8, 14 or 16 output locations) and the processor 1775 may monitor the type of coin receptacle (e.g., coin bag 170 or container 1000) located at each output location, set and adjust corresponding coin limits associated with each output location, and keep track of the state of fullness of each output location (e.g., empty, containing X number of coins where X is less than the corresponding coin limit, full).

According to some embodiments, a coin processing machine 10 has a plurality of output locations and is configured to send coins of a given denomination, e.g., dimes, to a first subset of the plurality of output locations. For example, a coin processing machine having 16 output locations, may be configured to send dimes to output locations #1-4, quarters to output locations #5-8, nickels to output locations #9-12, and pennies of output locations #13-16. According to some such embodiments, one to three of output locations for a given denomination (e.g., output location #1 for dimes) has a sleeve container 1000 properly positioned therein and the remaining location(s) do not have a sleeve container positioned therein but have a coin bag 170 properly positioned at the position(s). According to some such embodiments, the processor 1775 is configured to control the coin processing device 10 to give priority to sending coins to output locations having a coin container 1000 associated therewith and then when no non-full containers 1000 are available to received coins of a given denomination, to automatically send coins of that given denomination to output locations for that denomination having coin bags 170 thereat.

For example, if a container 1000 is properly inserted into output location #4 and coin bags 170 are at output locations #1-#3 and all output locations #1-#4 are to receive dimes, according to some embodiments, the processor will automatically set the coin limit for output location #4 to 2500 coins and set the coin limits for output locations #1-#3 to 10,000 coins. Then when one or more batches of coins are deposited into a coin input hopper of the coin processing device 10, the first 2500 dimes detected are delivered into the container 1000 at output location #4. The 2501$^{st}$ dime is then sent to a different one of the output locations #1-#3.

Once 2500 dimes have been delivered to the container 1000 at output location #4, the processor 1775 may cause an operator to be notified that output location #4 has reached its coin limit and/or needs to be replaced. According to some such embodiments, the coin processing device 10 thus does not need to stop in the middle of the processing of a batch of coins when output location #4 reaches its coin limit. Additionally or alternatively, giving priority to output locations having containers 1000 associated therewith permits priority filling of the containers 1000 over coins bags 170 which can be advantageous when coins of one or more denominations are desired for use with another coin processing device such as a coin dispensing machine. For example, when an establishment such as, for example, a bank, retailer, or casino, has both a coin processing device 10 and a coin dispensing machine 1600 and the coin dispensing machine has run out of or is running low on coins of a given denominations, e.g., dimes, then in between running batches of coins through the coin dispensing machine, a door near the output locations of the coin processing device 10 may be opened and a container 1000 may be inserted into a sleeve 120, 1220 located at an appropriate output location such as an empty output location (e.g., location #4 in the above example). The door of the coin processing device 10 may then be closed and one or more additional batches of coins may be processed by the coin processing device 10 until the container 1000 is filled with a desired number of dimes (e.g., 2500). When the processing of a batch of coins has been completed and the processor 1775 communicates to the operator that the container 1000 (e.g., at location #4) has reached its coin limit, the door near the output locations of the coin processing device 10 may be opened and the container 1000 full of dimes (e.g., the container 1000 in the sleeve 120, 1220 at output location #4) may be removed from the appropriate sleeve 120, 1200. The door of the coin processing device 10 may then be closed and one or more additional batches of coins may be processed by the coin processing machine 10 as desired. In the meantime, the container 1000 full of dimes may be used as needed in another machine such as being poured into an appropriate hopper 1610 of a coin dispensing machine 1600.

Figure 20:
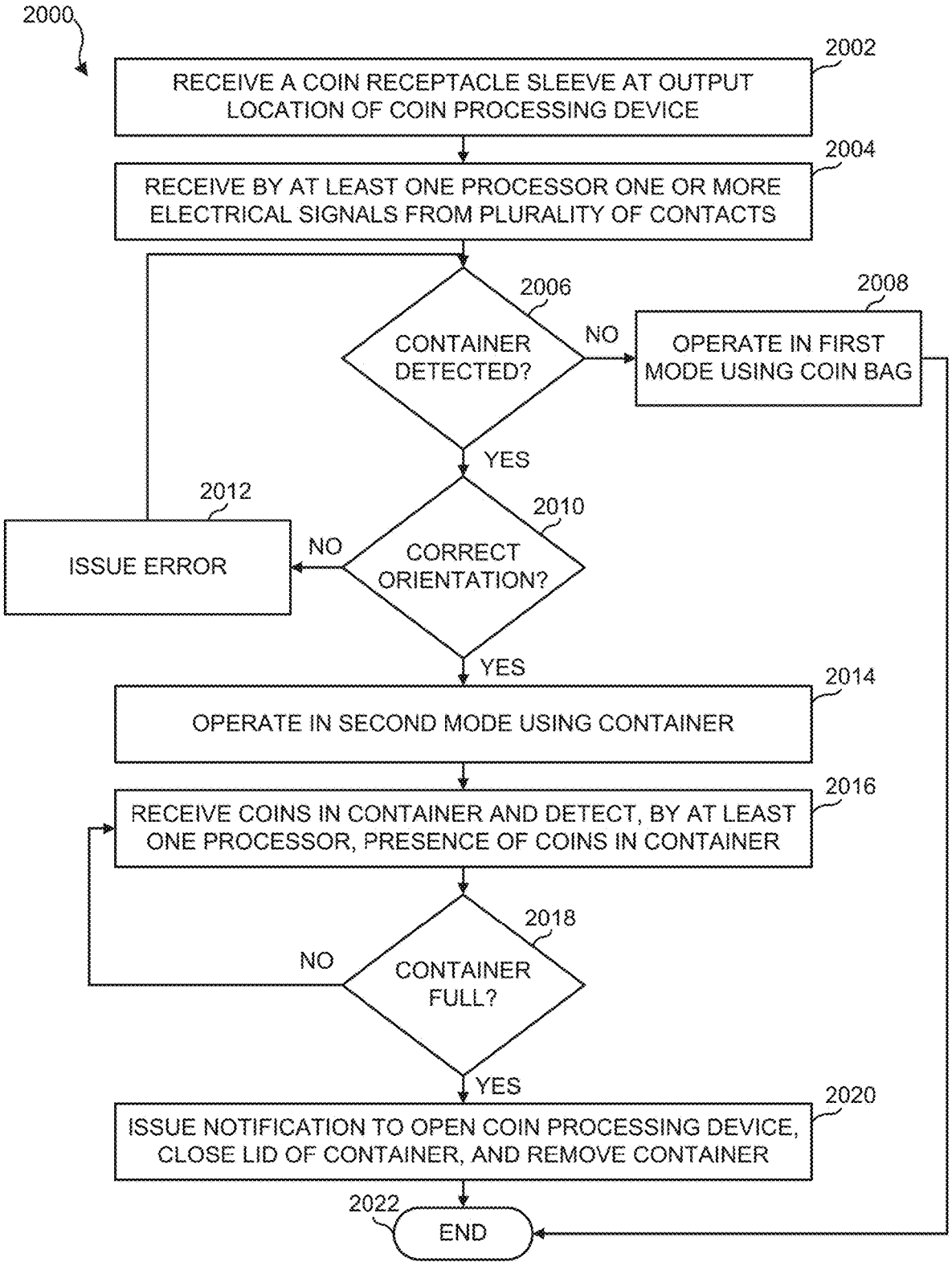
FIG. 20 illustrates an example mode detection process 2000 in accordance with various embodiments of this disclosure.

FIG. 20 illustrates an example mode detection process 2000 in accordance with various embodiments of this disclosure. The process 2000 can be used with various embodiments of coin processing devices disclosed herein, such as coin processing device 10. The process 2000 can be at least partially performed by at least one processor, such as processor 1775. The process 2000 begins at block 2002. At block 2002, the coin processing device receives a coin receptacle sleeve such as sleeve 1220 at an output location of the coin processing device, such as on the trolley base 110. At block 2004, the processor receives one or more electrical signals from a plurality of contacts, such as the various contacts disclosed herein, including at least one of the contacts 300, 310, 320, 330, 1010, 1120, 1310, 1320. In some embodiments, the electrical signals are received via the manifold contacts 330 and the electrical signals are altered depending on which other contacts the manifold contacts 330 are in contact.

At decision block 2006, the processor determines if a container is detected, such as the coin receptacle sleeve container 1000. If not, the process 2000 moves to block 2008, and the coin processing device operates in a first mode in which a coin bag is installed on the coin receptacle sleeve, as disclosed in the various embodiments herein. If, at decision block 2006, the processor detects a container, the process 2000 moves to decision block 2010. At decision block 2010, the processor determines if the installed container is in the correct orientation. As described in the various embodiments herein, the orientation of the container can be detected based on expected voltages and/or resistances being detected at different contacts, such as described with respect to FIG. 14B. If, at decision block 2010, the processor detects that the container is not in the correct orientation, at block 2012, the processor issues an error indicating that the orientation of the container is incorrect and requesting correction. The process 2000 moves from block 2012 back to decision block 2006. If, at decision block 2010, the processor determines that the container is in the correct orientation, the process 2000 moves to block 2014 to operate the coin processing device in a second mode using the installed container.

At block 2016, coins are received in the installed container and the processor detects the presence of the coins in the container. In some embodiments, at decision block 2018, the processor determines if the container is full, such as if the coins in the container reach a certain fill level in the container as detected by the electrical contacts in contact with the coins, or based on a tracked number of coins deposited into the container. If the container is not full, the processor 2000 loops back to block 2016. If the container is full, the process 2000 moves to block 2020. At block 2020, the processor issues a notification indicating the container is full. In some embodiments, the notification can include instructions to open the coin processing device, close the lid of the container, and remove the full container from the coin processing device. The process 2000 ends at block 2022.

In one example embodiment a coin processing device comprises a coin processing module including an inlet for receiving coins to be processed and at least one outlet for discharging the coins processed by the coin processing module, and at least one coin output location, including an elongated sleeve for receiving the coins from the at least one outlet, the elongated sleeve including a first opening through which the coins are received from the at least one outlet and a second opening, wherein the elongated sleeve is operable to receive, in a first mode of operation of the coin processing device, a first flexible walled coin receptacle about the elongated sleeve, wherein the second opening of the elongated sleeve is positioned within the first flexible walled coin receptacle, and wherein, in the first mode of operation, the coins are delivered by the elongated sleeve into the first flexible walled coin receptacle, and receive, in a second mode of operation of the coin processing device, a second coin receptacle within the elongated sleeve, wherein the second coin receptacle is a generally rigid container, and wherein, in the second mode of operation, the coins are delivered from the at least one outlet into the second coin receptacle positioned within the elongated sleeve.

In one or more of the above examples, the coin processing device further comprises a manifold including a first plurality of electrical contacts, wherein the elongated sleeve includes a second plurality of electrical contacts configured to abut the first plurality of electrical contacts of the manifold when in the first mode of operation.

In one or more of the above examples, the second coin receptacle includes a lid disposed at an opening of the second coin receptacle, wherein the lid is operable to move between an open position to receive the coins and a closed position for retrieval of the second coin receptacle.

In one or more of the above examples, the lid of the second coin receptacle includes a spring biased latch to maintain the lid in the closed position and a handle coupled to a top surface of the lid for removal of the second coin receptacle when the lid is in the closed position.

In one or more of the above examples, the lid of the second coin receptacle includes a third plurality of electrical contacts disposed through the lid, wherein, in the second mode of operation and when the lid is in the open position, the third plurality of electrical contacts abut the first plurality of contacts of the manifold on a first side of the lid and the third plurality of electrical contacts abut the second plurality of contacts of the elongated sleeve on a second side of the lid.

In one or more of the above examples, the coin processing device further comprises at least one processor communicatively coupled to the first plurality of electrical contacts of the manifold, wherein the at least one processor is configured to receive one or more electrical signals indicating at least one of a presence or an absence of the elongated sleeve, a presence or an absence of the second coin receptacle, and an orientation of the second coin receptacle within the elongated sleeve.

In one or more of the above examples, the third plurality of electrical contacts of the lid of the second coin receptacle includes at least one resistor and at least one diode configured to alter the one or more electrical signals provided to the at least one processor from each of the third plurality of electrical contacts to enable the at least one processor to differentiate between the second plurality of electrical contacts of the elongated sleeve and the third plurality of electrical contacts of the lid to determine the presence or the absence of the second coin receptacle, and to enable the at least one processor to differentiate between each one of the third plurality of electrical contacts to determine the orientation of the second coin receptacle.

In one or more of the above examples, the second coin receptacle includes a fourth plurality of contacts disposed through a body of the second coin receptacle, wherein at least a first portion of each of the third plurality of electrical contacts is disposed within an interior of the second coin receptacle to contact coins stored in the second coin receptacle, wherein at least a second portion of each of the third plurality of electrical contacts is disposed on an exterior portion of the second coin receptacle to contact at least one electrically conductive material on the elongated sleeve when the second coin receptacle is disposed within the elongated sleeve, wherein the electrically conductive material on the elongated sleeve is coupled to the second plurality of electrical contacts of the elongated sleeve, and wherein the coin processing device further comprises at least one processor communicatively coupled to the first plurality of electrical contacts of the manifold, wherein the at least one processor is configured to receive one or more electrical signals indicating at least one of a presence or an absence of the elongated sleeve, a presence or an absence of the second coin receptacle, an orientation of the second coin receptacle within the elongated sleeve, and a presence or an absence of coins in the second coin receptacle.

In one or more of the above examples, the second coin receptacle includes a third plurality of electrical contacts disposed through a body of the second coin receptacle, wherein at least a first portion of each of the third plurality of electrical contacts is disposed within an interior of the second coin receptacle to contact coins stored in the second coin receptacle, wherein at least a second portion of each of the third plurality of electrical contacts is disposed on an exterior portion of the second coin receptacle to contact at least one electrically conductive material on the elongated sleeve when the second coin receptacle is disposed within the elongated sleeve, and wherein the electrically conductive material on the elongated sleeve is coupled to the second plurality of electrical contacts of the elongated sleeve.

In one or more of the above examples, the coin processing device further comprises at least one processor communicatively coupled to the first plurality of electrical contacts of the manifold, wherein the at least one processor is configured to receive one or more electrical signals indicating at least one of a presence or an absence of the elongated sleeve or a presence or an absence of coins in the second coin receptacle.

In one or more of the above examples, the coin processing device further comprises a housing including a door and a trolley base, wherein the elongated sleeve is coupled to the trolley base, wherein the trolley base is operable to, when the door of the housing is in an open position, move into the housing to position the elongated sleeve in an operational position and move out of the housing to position the elongated sleeve in a non-operational position, wherein the second coin receptacle may be received within the elongated sleeve when the trolley base has been moved out of the housing, and wherein, after the second coin receptacle has been received within the elongated sleeve, the trolley base is moved back into the housing to position the elongated sleeve in the operational position before the coin processing device is operated in the second mode of operation.

In another example embodiment of a method of operating a coin processing device, the coin processing device comprising an inlet and at least one coin outlet and a plurality of output locations, each of the plurality of output locations including an elongated sleeve associated therewith for receiving coins from the at least one outlet, the elongated sleeve of each output location including a first end and a second end, a first opening positioned near the first end of the elongated sleeve, and a second opening positioned near the second end of the elongated sleeve, the method comprising receiving, by the elongated sleeve and in a first mode of operation of the coin processing device, a first flexible walled coin receptacle about the elongated sleeve, whereby the second opening of the elongated sleeve is positioned within the first flexible walled coin receptacle, receiving, in the first mode of operation, the coins in the elongated sleeve whereby the coins received into the elongated sleeve are delivered into the first flexible walled coin receptacle, receiving, by the elongated sleeve and in a second mode of operation of the coin processing device, a second coin receptacle, wherein the second coin receptacle is a generally rigid container, and receiving, in the second mode of operation, the coins in the elongated sleeve whereby the coins received into the elongated sleeve are delivered into the second coin receptacle.

In one or more of the above examples, the method further comprises abutting, when in the first mode of operation, a first plurality of electrical contacts of a manifold of the coin processing device with a second plurality of electrical contacts of the elongated sleeve.

In one or more of the above examples, the second coin receptacle includes a lid disposed at an opening of the second coin receptacle, the method further comprising moving the lid between an open position to receive the coins and a closed position for retrieval of the second coin receptacle.

In one or more of the above examples, the lid of the second coin receptacle includes a third plurality of electrical contacts disposed through the lid, the method further comprising, in the second mode of operation and when the lid is in the open position abutting, on a first side of the lid, the third plurality of electrical contacts of the lid of the second coin receptacle with the first plurality of contacts of the manifold on a first side of the lid, and abutting, on a second side of the lid, the third plurality of electrical contacts of the second coin receptacle with the second plurality of contacts of the elongated sleeve.

In one or more of the above examples, the method further comprises receiving, by at least one processor communicatively coupled to the first plurality of electrical contacts, one or more electrical signals indicating at least one of a presence or an absence of the elongated sleeve, a presence or an absence of the second coin receptacle, and an orientation of the second coin receptacle within the elongated sleeve.

In one or more of the above examples, the third plurality of electrical contacts of the lid of the second coin receptacle includes at least one resistor and at least one diode configured to alter the one or more electrical signals provided to the at least one processor from each of the third plurality of electrical contacts to enable the at least one processor to differentiate between the second plurality of electrical contacts of the elongated sleeve and the third plurality of electrical contacts of the lid to determine the presence or the absence of the second coin receptacle, and to enable the at least one processor to differentiate between each one of the third plurality of electrical contacts to determine the orientation of the second coin receptacle.

In one or more of the above examples, the second coin receptacle includes a third plurality of electrical contacts disposed through a body of the second coin receptacle, wherein at least a first portion of each of the third plurality of electrical contacts is disposed within an interior of the second coin receptacle to contact coins stored in the second coin receptacle, wherein at least a second portion of each of the third plurality of electrical contacts is disposed on an exterior portion of the second coin receptacle, and wherein the elongated sleeve includes at least one electrically conductive material coupled to the second plurality of electrical contacts of the elongated sleeve, the method further comprising contacting, by the second portion of each of the third plurality of electrical contacts, the at least one electrically conductive material on the elongated sleeve when the second coin receptacle is disposed within the elongated sleeve.

In one or more of the above examples, the method further comprises receiving, by at least one processor communicatively coupled to the first plurality of electrical contacts, one or more electrical signals indicating at least one of a presence or an absence of the elongated sleeve or a presence or an absence of coins in the second coin receptacle.

In one or more of the above examples, the method further comprises moving, when a door of a housing of the coin processing device is in an open position, a trolley base of the coin processing device out of the housing to position the elongated sleeve in a non-operational position, receiving, by the trolley base when the trolley base has been moved out of the housing, the second coin receptacle within the elongated sleeve, and moving, after the second coin receptacle has been received within the elongated sleeve, the trolley base into the housing to position the elongated sleeve in an operational position before the coin processing device is operated in the second mode of operation.

In another example embodiment, a coin processing device comprises a coin processing module having an inlet for receiving loose coins to be processed and at least one outlet for discharging coins processed by the processing module and at least one coin output location, the output location comprising an elongated sleeve for receiving coins from the at least one outlet, the sleeve having a first opening through which coins are received from the at least one outlet and a second opening, a first flexible walled coin receptacle disposed about the sleeve whereby the second opening of the sleeve is positioned within the first flexible walled coin receptacle whereby in a first mode of operation of the coin processing device coins are delivered by the sleeve into the first coin receptacle, and a second coin receptacle receivable within the sleeve whereby in a second mode of operation of the coin processing device coins are delivered from the at least one outlet into the second coin receptacle positioned within the sleeve.

In another example embodiment, a coin processing device comprising at least one coin output location, the coin output location comprising an elongated sleeve for receiving coins from the at least one outlet having a first end and a second end, the sleeve having a first opening positioned near the first end of the sleeve through which coins are received from the at least one outlet, the sleeve having a second opening positioned near the second end of the sleeve, a first flexible walled coin receptacle disposed about the sleeve whereby the second opening of the sleeve is positioned within the first flexible walled coin receptacle whereby in a first mode of operation of the coin processing device coins are delivered by the sleeve into the first coin receptacle, and a second coin receptacle receivable within the sleeve whereby in a second mode of operation of the coin processing device coins are delivered from the at least one outlet into the second coin receptacle positioned within the sleeve.

In another example embodiment, a coin processing device comprises a plurality of output locations, each output location comprising an elongated sleeve for receiving coins from the at least one outlet having a first end and a second end, the sleeve having a first opening positioned near the first end of the sleeve through which coins are received from the at least one outlet, the sleeve having a second opening positioned near the second end of the sleeve, a first flexible walled coin receptacle disposed about a first one of the sleeves associated with a first one of the output locations whereby the second opening of the first sleeve is positioned within the first flexible walled coin receptacle whereby coins delivered into the first sleeve are delivered into the first coin receptacle, and a second coin receptacle positioned within a second one of the sleeves associated with a second one of the output locations whereby coins delivered from the at least one outlet into the second sleeve are delivered into the second coin receptacle positioned within the second sleeve.

In another example embodiment of method of operating a coin processing device, the coin processing device comprising at least one coin outlet and a plurality of output locations, each output location having an elongated sleeve associated therewith for receiving coins from the at least one outlet, each sleeve having a first end and a second end, each sleeve having a first opening positioned near the first end of the sleeve, each sleeve having a second opening positioned near the second end of the sleeve, the method comprising positioning a first flexible coin bag about a first one of the sleeves associated with a first one of the output locations whereby the second opening of the first sleeve is positioned within the first flexible walled coin bag, receiving coins in the first sleeve whereby coins received into the first sleeve are delivered into the first coin bag, positioning a second coin receptacle within a second one of the sleeves associated with a second one of the output locations, receiving coins delivered from the at least one outlet to the second output location into the second coin receptacle positioned within the second sleeve.

In one or more of the above examples, the second coin receptacle is a generally rigid container.

In one or more of the above examples, a second flexible coin bag is positioned about the second sleeve, and the method further comprises removing the second coin receptacle from the second sleeve and thereafter receiving coins in the second sleeve whereby coins received into the second sleeve are delivered into the second coin bag.

In one or more of the above examples, the second coin bag has a first coin limit associated therewith and the second coin receptacle has a second coin limit associated therewith wherein the second coin limit is less than the first coin limit, the method further comprising the coin processing device automatically detecting when the second coin receptacle has been removed from the second sleeve; and automatically adjusting a coin limit associated with the second output location from the second coin limit to the first coin limit, wherein the act of thereafter receiving coins in the second sleeve whereby coins received into the second sleeve are delivered into the second coin bag comprises receiving more coins than the second coin limit in the second sleeve.

In another example embodiment of a method of operating a coin processing device, the coin processing device comprising at least one coin outlet and a plurality of output locations, each output location having an elongated sleeve associated therewith for receiving coins from the at least one outlet, each sleeve having a first end and a second end, each sleeve having a first opening positioned near the first end of the sleeve, each sleeve having a second opening positioned near the second end of the sleeve, wherein a first flexible coin bag is positioned about a first one of the sleeves associated with a first one of the output locations whereby the second opening of the first sleeve is positioned within the first flexible walled coin bag, wherein a second coin receptacle is positioned within a second one of the sleeves associated with a second one of the output locations the method comprising receiving coins in the first sleeve whereby coins received into the first sleeve are delivered into the first coin bag, receiving coins delivered from the at least one outlet to the second output location into the second coin receptacle positioned within the second sleeve.

In another example embodiment of a method of operating a coin processing device, the coin processing device comprising at least one coin outlet and a plurality of output locations, each output location having an elongated sleeve associated therewith for receiving coins from the at least one outlet, each sleeve having a first end and a second end, each sleeve having a first opening positioned near the first end of the sleeve, each sleeve having a second opening positioned near the second end of the sleeve, wherein a first flexible coin bag is positioned about each of the sleeves associated with the plurality of the output locations whereby the second opening of each sleeve is positioned within a respective one of the flexible walled coin bags, the method comprising positioning a coin receptacle within a first one of the sleeves associated with a first one of the output locations, receiving coins delivered from the at least one outlet to the first output location into the coin receptacle positioned within the first sleeve, removing the coin receptacle from the first sleeve, and thereafter receiving coins in the first sleeve whereby coins received into the first sleeve are delivered into the first coin bag.

In another example embodiment of a method of operating a coin processing device, the coin processing device comprising at least one coin outlet and a plurality of output locations, each output location having an elongated sleeve associated therewith for receiving coins from the at least one outlet, each sleeve having a first end and a second end, each sleeve having a first opening positioned near the first end of the sleeve, each sleeve having a second opening positioned near the second end of the sleeve, wherein a first flexible coin bag is associated with each of the sleeves associated with the plurality of the output locations, the method comprising positioning a coin receptacle within a first one of the sleeves associated with a first one of the output locations, receiving coins delivered from the at least one outlet to the first output location into the coin receptacle positioned within the first sleeve, removing the coin receptacle from the first sleeve, and thereafter receiving coins in the first sleeve whereby coins received into the first sleeve are delivered into the first coin bag.

In another example embodiment, a convertible coin output location includes a flexible coin bag associated therewith and sometimes having a removeable second generally rigid container associated therewith, wherein the convertible coin output location delivers coins to the flexible coin bag when the second generally rigid container is not present at the output location, and wherein the convertible coin output location delivers coins to the second rigid container when the second generally rigid container is present at the output location.

In another example embodiment, a coin processing device comprises a housing having at least one door, a coin processing module having an inlet for receiving loose coins to be processed and at least one outlet for discharging coins processed by the processing module, and at least one coin output location, the output location comprising an elongated sleeve for receiving coins from the at least one outlet, the sleeve having a first opening through which coins are received from the at least one outlet and a second opening, wherein the sleeve is coupled to a trolley base and wherein the trolley base is configured to be moved into the housing to position the sleeve in an operational position and wherein the trolley base is configured to be moved out of the housing when the door of the housing is in an open position to position the sleeve in a non-operational position, a flexible walled coin bag disposed about the sleeve whereby the second opening of the sleeve is positioned within the first flexible walled coin bag whereby in a first mode of operation of the coin processing device coins are delivered by the sleeve into the first coin receptacle, and a second coin receptacle receivable within the sleeve whereby in a second mode of operation of the coin processing device coins are delivered from the at least one outlet into the second coin receptacle positioned within the sleeve; wherein the second coin receptacle may be received within the sleeve when the trolley base has been moved out of the housing and wherein after the second coin receptacle has been received within the sleeve, the trolley base is moved back into the housing to position the sleeve in the operational position before the coin processing device is operated in the second mode of operation.

In another example embodiment, a coin processing device operable is a first mode of operation and a second mode of operation comprises a housing, a coin processing module having an inlet for receiving loose coins to be processed and at least one outlet for discharging coins processed by the processing module, and at least one coin output location, a coin bag coupler for receiving coins from the at least one outlet, the coupler having a first opening through which coins are received from the at least one outlet and a second opening, wherein the coupler is configured to be moved into the housing to position the coupler in an operational position and wherein the coupler is configured to be moved out of the housing to position the coupler in a non-operational position, a flexible walled coin bag positioned to receive coins from the second opening of the coupler when the coupled is positioned in the operational position whereby in a first mode of operation of the coin processing device coins are delivered by the coupler into the first coin receptacle, and a second coin receptacle positioned at least partially within the coupler whereby in a second mode of operation of the coin processing device coins are delivered from the at least one outlet into the second coin receptacle, wherein the second coin receptacle may be positioned at least partially within the coupler when the coupler has been moved out of the housing and wherein after the second coin receptacle has been positioned at least partially within the coupler, the coupler is moved back into the housing to position the coupler in the operational position before the operation of the coin processing device in the second mode of operation.

In another example embodiment, a coin processing device comprises a coin processing module having an inlet for receiving loose coins to be processed and at least one outlet for discharging coins processed by the processing module, and at least one coin output location, the output location comprising a container for receiving coins from the at least one outlet, the container having a first opening through which coins are received from the at least one outlet and a second opening, a first flexible walled coin receptacle disposed about the container whereby the second opening of the container is positioned within the first flexible walled coin receptacle whereby in a first mode of operation of the coin processing device coins are delivered by the container into the first coin receptacle, and a second coin receptacle receivable within the container whereby in a second mode of operation of the coin processing device coins are delivered from the at least one outlet into the second coin receptacle positioned within the container.

While the concepts disclosed herein are susceptible to various modifications and alternative forms, specific embodiments thereof have been shown by way of example in the drawings and herein described in detail. It should be understood, however, that it is not intended to limit the inventions to the particular forms disclosed, but on the contrary, the intention is to cover all modifications, equivalents, and alternatives falling within the spirit and scope of the inventions as defined by the appended claims.

What is claimed is:

1. A coin processing device, comprising:

a coin processing module including an inlet for receiving coins to be processed and at least one outlet for discharging the coins processed by the coin processing module; and at least one coin output location, including:

an elongated sleeve for receiving the coins from the at least one outlet, the elongated sleeve including a first opening through which the coins are received from the at least one outlet and a second opening, wherein the elongated sleeve is operable to:

receive, in a first mode of operation of the coin processing device, a first flexible walled coin receptacle about the elongated sleeve, wherein the second opening of the elongated sleeve is positioned within the first flexible walled coin receptacle, and wherein, in the first mode of operation, the coins are delivered by the elongated sleeve into the first flexible walled coin receptacle; and receive, in a second mode of operation of the coin processing device, a second coin receptacle within the elongated sleeve, wherein the second coin receptacle is a generally rigid container, and wherein, in the second mode of operation, the coins are delivered from the at least one outlet into the second coin receptacle positioned within the elongated sleeve.

2. The coin processing device of claim 1, further comprising a manifold including a first plurality of electrical contacts, wherein the elongated sleeve includes a second plurality of electrical contacts configured to abut the first plurality of electrical contacts of the manifold when in the first mode of operation.

3. The coin processing device of claim 2, wherein the second coin receptacle includes a lid disposed at an opening of the second coin receptacle, wherein the lid is operable to move between an open position to receive the coins and a closed position for retrieval of the second coin receptacle.

4. The coin processing device of claim 3, wherein the lid of the second coin receptacle includes:

a spring biased latch to maintain the lid in the closed position; and a handle coupled to a top surface of the lid for removal of the second coin receptacle when the lid is in the closed position.

5. The coin processing device of claim 4, wherein the lid of the second coin receptacle includes a third plurality of electrical contacts disposed through the lid, wherein, in the second mode of operation and when the lid is in the open position, the third plurality of electrical contacts abut the first plurality of contacts of the manifold on a first side of the lid and the third plurality of electrical contacts abut the second plurality of contacts of the elongated sleeve on a second side of the lid.

6. The coin processing device of claim 5, further comprising at least one processor communicatively coupled to the first plurality of electrical contacts of the manifold, wherein the at least one processor is configured to receive one or more electrical signals indicating at least one of a presence or an absence of the elongated sleeve, a presence or an absence of the second coin receptacle, and an orientation of the second coin receptacle within the elongated sleeve.

7. The coin processing device of claim 6, wherein the third plurality of electrical contacts of the lid of the second coin receptacle includes at least one resistor and at least one diode configured to alter the one or more electrical signals provided to the at least one processor from each of the third plurality of electrical contacts to enable the at least one processor to differentiate between the second plurality of electrical contacts of the elongated sleeve and the third plurality of electrical contacts of the lid to determine the presence or the absence of the second coin receptacle, and to enable the at least one processor to differentiate between each one of the third plurality of electrical contacts to determine the orientation of the second coin receptacle.

8. The coin processing device of claim 5, wherein the second coin receptacle includes a fourth plurality of contacts disposed through a body of the second coin receptacle, wherein at least a first portion of each of the third plurality of electrical contacts is disposed within an interior of the second coin receptacle to contact coins stored in the second coin receptacle, wherein at least a second portion of each of the third plurality of electrical contacts is disposed on an exterior portion of the second coin receptacle to contact at least one electrically conductive material on the elongated sleeve when the second coin receptacle is disposed within the elongated sleeve, wherein the electrically conductive material on the elongated sleeve is coupled to the second plurality of electrical contacts of the elongated sleeve, and wherein the coin processing device further comprises at least one processor communicatively coupled to the first plurality of electrical contacts of the manifold, wherein the at least one processor is configured to receive one or more electrical signals indicating at least one of a presence or an absence of the elongated sleeve, a presence or an absence of the second coin receptacle, an orientation of the second coin receptacle within the elongated sleeve, and a presence or an absence of coins in the second coin receptacle.

9. The coin processing device of claim 2, wherein the second coin receptacle includes a third plurality of electrical contacts disposed through a body of the second coin receptacle, wherein at least a first portion of each of the third plurality of electrical contacts is disposed within an interior of the second coin receptacle to contact coins stored in the second coin receptacle, wherein at least a second portion of each of the third plurality of electrical contacts is disposed on an exterior portion of the second coin receptacle to contact at least one electrically conductive material on the elongated sleeve when the second coin receptacle is disposed within the elongated sleeve, and wherein the electrically conductive material on the elongated sleeve is coupled to the second plurality of electrical contacts of the elongated sleeve.

10. The coin processing device of claim 9, further comprising at least one processor communicatively coupled to the first plurality of electrical contacts of the manifold, wherein the at least one processor is configured to receive one or more electrical signals indicating at least one of a presence or an absence of the elongated sleeve or a presence or an absence of coins in the second coin receptacle.

11. The coin processing device of claim 1, further comprising:

a housing including a door; and a trolley base, wherein the elongated sleeve is coupled to the trolley base, wherein the trolley base is operable to, when the door of the housing is in an open position, move into the housing to position the elongated sleeve in an operational position and move out of the housing to position the elongated sleeve in a non-operational position, wherein the second coin receptacle may be received within the elongated sleeve when the trolley base has been moved out of the housing, and wherein, after the second coin receptacle has been received within the elongated sleeve, the trolley base is moved back into the housing to position the elongated sleeve in the operational position before the coin processing device is operated in the second mode of operation.

12. A method of operating a coin processing device, the coin processing device comprising an inlet and at least one coin outlet and a plurality of output locations, each of the plurality of output locations including an elongated sleeve associated therewith for receiving coins from the at least one outlet, the elongated sleeve of each output location including a first end and a second end, a first opening positioned near the first end of the elongated sleeve, and a second opening positioned near the second end of the elongated sleeve, the method comprising:

receiving, by the elongated sleeve and in a first mode of operation of the coin processing device, a first flexible walled coin receptacle about the elongated sleeve, whereby the second opening of the elongated sleeve is positioned within the first flexible walled coin receptacle;

receiving, in the first mode of operation, the coins in the elongated sleeve whereby the coins received into the elongated sleeve are delivered into the first flexible walled coin receptacle;

receiving, by the elongated sleeve and in a second mode of operation of the coin processing device, a second coin receptacle, wherein the second coin receptacle is a generally rigid container; and receiving, in the second mode of operation, the coins in the elongated sleeve whereby the coins received into the elongated sleeve are delivered into the second coin receptacle.

13. The method of claim 12, the method further comprising abutting, when in the first mode of operation, a first plurality of electrical contacts of a manifold of the coin processing device with a second plurality of electrical contacts of the elongated sleeve.

14. The method of claim 13, wherein the second coin receptacle includes a lid disposed at an opening of the second coin receptacle, the method further comprising moving the lid between an open position to receive the coins and a closed position for retrieval of the second coin receptacle.

15. The method of claim 14, wherein the lid of the second coin receptacle includes a third plurality of electrical contacts disposed through the lid, the method further comprising, in the second mode of operation and when the lid is in the open position:

abutting, on a first side of the lid, the third plurality of electrical contacts of the lid of the second coin receptacle with the first plurality of contacts of the manifold on a first side of the lid; and abutting, on a second side of the lid, the third plurality of electrical contacts of the second coin receptacle with the second plurality of contacts of the elongated sleeve.

16. The method of claim 15, further comprising receiving, by at least one processor communicatively coupled to the first plurality of electrical contacts, one or more electrical signals indicating at least one of a presence or an absence of the elongated sleeve, a presence or an absence of the second coin receptacle, and an orientation of the second coin receptacle within the elongated sleeve.

17. The method of claim 16, wherein the third plurality of electrical contacts of the lid of the second coin receptacle includes at least one resistor and at least one diode configured to alter the one or more electrical signals provided to the at least one processor from each of the third plurality of electrical contacts to enable the at least one processor to differentiate between the second plurality of electrical contacts of the elongated sleeve and the third plurality of electrical contacts of the lid to determine the presence or the absence of the second coin receptacle, and to enable the at least one processor to differentiate between each one of the third plurality of electrical contacts to determine the orientation of the second coin receptacle.

18. The method of claim 13, wherein the second coin receptacle includes a third plurality of electrical contacts disposed through a body of the second coin receptacle, wherein at least a first portion of each of the third plurality of electrical contacts is disposed within an interior of the second coin receptacle to contact coins stored in the second coin receptacle, wherein at least a second portion of each of the third plurality of electrical contacts is disposed on an exterior portion of the second coin receptacle, and wherein the elongated sleeve includes at least one electrically conductive material coupled to the second plurality of electrical contacts of the elongated sleeve, the method further comprising:

contacting, by the second portion of each of the third plurality of electrical contacts, the at least one electrically conductive material on the elongated sleeve when the second coin receptacle is disposed within the elongated sleeve.

19. The method of claim 18, further comprising receiving, by at least one processor communicatively coupled to the first plurality of electrical contacts, one or more electrical signals indicating at least one of a presence or an absence of the elongated sleeve or a presence or an absence of coins in the second coin receptacle.

20. The method of claim 12, further comprising:

moving, when a door of a housing of the coin processing device is in an open position, a trolley base of the coin processing device out of the housing to position the elongated sleeve in a non-operational position;

receiving, by the trolley base when the trolley base has been moved out of the housing, the second coin receptacle within the elongated sleeve; and moving, after the second coin receptacle has been received within the elongated sleeve, the trolley base into the housing to position the elongated sleeve in an operational position before the coin processing device is operated in the second mode of operation.

* * * * *